US012716227B2

(12) United States Patent
Chapel et al.

(10) Patent No.: US 12,716,227 B2
(45) Date of Patent: Aug. 25, 2026

(54) CONDENSED SUMP PUMP CROCK

(71) Applicant: Independence Materials Group, LLC, Virginia Beach, VA (US)

(72) Inventors: Karl Chapel, Grand Haven, MI (US); Austin Robert Genord, Commerce Township, MI (US)

(73) Assignee: Independence Materials Group, LLC, Virginia Beach, VA (US)

( * ) Notice: Subject to any disclaimer, the term of this patent is extended or adjusted under 35 U.S.C. 154(b) by 285 days.

(21) Appl. No.: 18/219,806

(22) Filed: Jul. 10, 2023

(65) Prior Publication Data

US 2024/0018769 A1 Jan. 18, 2024

Related U.S. Application Data

(60) Provisional application No. 63/389,453, filed on Jul. 15, 2022.

(51) Int. Cl.
*E03F 5/22* (2006.01)

(52) U.S. Cl.
CPC ..... *E03F 5/22* (2013.01)

(58) Field of Classification Search
CPC ..... E03F 5/22
See application file for complete search history.

(56) References Cited

U.S. PATENT DOCUMENTS 3,595,398 A 7/1971 Cook
4,039,005 A * 8/1977 Clifford ..... E03F 5/0405 137/885
4,863,053 A 9/1989 Oberg
4,890,425 A 1/1990 Mamula
5,049,024 A 9/1991 Chien
5,366,318 A * 11/1994 Brancher ..... E03F 5/02 285/236
5,617,679 A * 4/1997 Meyers ..... E02D 29/12 405/136
5,870,871 A * 2/1999 Stewart ..... E02D 29/125 52/514
6,276,093 B1 8/2001 Janesky
(Continued)

FOREIGN PATENT DOCUMENTS

EP 2735348 A1 5/2014
GB 1363302 A 8/1974
GB 2432891 A 6/2007

*Primary Examiner* — Frederick L Lagman
(74) *Attorney, Agent, or Firm* — Moore & Van Allen PLLC; Jeffrey R. Gray

(57) ABSTRACT

A sump pump crock includes a body including an upper body and a lower body, wherein the external surface of the upper body, and in some embodiments the inner surface of the upper body, extends radially past the external surface of the lower body. The body may also include two or more flanges, including at least one upper flange on the upper body that extends radially past the at least one lower flange on the lower body. Furthermore, the lower body of the sump pump crock may include one or more ports, such as to provide a lower location for attachment of components (e.g., a perimeter drain). The sump pump crock may further include a first portion and a second portion that is separate from the first portion, which when assembled form the upper body and the lower body.

19 Claims, 17 Drawing Sheets

(56) References Cited

U.S. PATENT DOCUMENTS

| | | | | |
|---|---|---|---|---|
| 6,305,410 | B1 * | 10/2001 | Cook | E03F 5/22 137/565.17 |
| 7,303,357 | B2 * | 12/2007 | Villarreal | E03F 5/0401 405/36 |
| 7,788,877 | B2 * | 9/2010 | Andras | E04B 1/7023 52/302.1 |
| 8,454,267 | B2 * | 6/2013 | Ireland | E03F 5/22 405/52 |
| 9,004,381 | B2 * | 4/2015 | Schmidt | F04D 7/045 417/430 |
| 9,574,338 | B1 * | 2/2017 | Cannon | E03F 5/02 |
| 10,035,156 | B2 | 7/2018 | Gerson et al. | |
| 10,343,840 | B2 * | 7/2019 | McDuffe | B65D 90/0006 |
| 10,443,224 | B1 * | 10/2019 | Sykes | E03F 5/22 |
| 11,306,462 | B2 * | 4/2022 | Casciano | E02B 11/00 |
| 11,939,117 | B2 * | 3/2024 | Genord | B65D 45/22 |
| 2006/0048756 | A1 | 3/2006 | Ikeya | |
| 2008/0155929 | A1 | 7/2008 | Herron | |
| 2009/0183785 | A1 * | 7/2009 | Cole | F04D 13/16 417/423.9 |
| 2010/0065131 | A1 * | 3/2010 | Grooms | E03F 1/007 137/205 |
| 2017/0016202 | A1 | 1/2017 | Stiatti et al. | |
| 2019/0353156 | A1 | 11/2019 | Ward et al. | |
| 2021/0163189 | A1 | 6/2021 | Genord et al. | |
| 2024/0228130 | A1 * | 7/2024 | Genord | E03F 5/024 |

* cited by examiner

CONDENSED SUMP PUMP CROCK

PRIORITY CLAIM UNDER 35 U.S.C. § 119

This application claims priority to U.S. Provisional Application No. 63/389,453 entitled "Condensed Sump Pump Crock" filed on Jul. 15, 2022, which is assigned to the assignee hereof and the entirety of which is incorporated by reference herein.

FIELD

This application relates to a sump pump crock, and more particularly, a condensed sump pump crock that provides a low profile for installation within areas with reduced clearances.

BACKGROUND

A sump pump crock is a basin utilized within the ground to collect water and houses a pump to remove the water from the basin.

SUMMARY

A sump pump crock includes a body including an upper body and a lower body, wherein the external surface of the upper body, and in some embodiments the inner surface of the upper body, extends radially past the external surface of the lower body. The body may also include two or more flanges, including at least one upper flange on the upper body that extends radially past the at least one lower flange on the lower body. Moreover, in some embodiments only the lower body includes the plurality of perforations that allows water to flow into and/or out of the sump pump crock. Furthermore, the lower body of the sump pump crock may include one or more ports, such as to provide a lower location for attachment of components (e.g., perimeter drain, or the like). The sump pump crock may further include a first portion and a second portion that is separate from the first portion. The first portion may have a first upper body and a first lower body, while the second portion may have a second upper body and a second lower body. When the first portion and the second portion are operatively coupled together, the first upper body and the second upper body form the upper body, while the first lower body and the second lower body form the lower body. The sump pump crock may include a removeable lid that at least partially covers the top opening.

Embodiments of the invention comprise a sump pump crock. The sump pump crock having a body comprising an upper body having one or more upper sidewalls forming an upper opening, and a lower body having one or more lower sidewalls and a base. The upper body comprises an upper external surface and an upper internal surface, and the lower body comprises a lower external surface and a lower internal surface. The upper external surface extends radially past the lower external surface and the lower internal surface.

In further accord with embodiments, the upper internal surface extends radially past the lower external surface.

In other embodiments, the lower body comprises one or more ports, wherein the one or more ports are configured to be operatively coupled to a drain.

In still other embodiments, the one or more ports are removable and wherein the drain is a perimeter drain.

In yet other embodiments, the sump pump further comprises an internal shoulder between the upper internal surface and the lower internal surface.

In other embodiments, the internal shoulder is at least partially sloped from the upper internal surface downwardly towards the lower internal surface.

In further accord with embodiments, the body comprises a first portion having a first upper body and a first lower body, and a second portion having a second upper body and a second lower body. The first portion and the second portion are removably operatively coupled together. The first upper body and the second upper body form the upper body, and the first lower body and the second lower body form the lower body.

In other embodiments, the first portion comprises a first base portion and the second portion comprises a second base portion. The first base portion and the second base portion comprise the base of the lower body.

In still other embodiments, the first portion includes one of a first tab and a first receptacle and the second portion includes one of a second tab and a second receptacle, wherein the first tab is received in the second receptacle and the second tab is received in the first receptable to operatively couple the first portion to the second portion.

In yet other embodiments, the first portion includes three first tabs and three first openings, and the second portion includes three second tabs and three second openings.

In other embodiments, the sump pump crock further comprises a removeable lid that covers a top opening in the body.

In further accord with embodiments, the sump pump crock further comprises two or more flanges that extend at least partially around the body. The two or more flanges comprise an upper flange that extends at least partially around the upper body and a lower flange that extends at least partially around the lower body. The upper flange extends radially past the lower flange.

In other embodiments, the one or more lower sidewalls have a plurality of perforations in at least one sidewall of the one or more lower sidewalls of the lower body.

Other embodiments of the sump pump crock comprise a body having an upper body having one or more upper sidewalls forming an upper opening, and a lower body having one or more lower sidewalls and a base. The body further comprises two or more flanges that extend at least partially around the body, wherein the two or more flanges comprise an upper flange that extends at least partially around the upper body, and a lower flange that extends at least partially around the lower body. The upper flange extends radially past the lower flange.

In further accord with embodiments, the upper body comprises an upper external surface and an upper internal surface, and the lower body comprises a lower external surface and a lower internal surface. The upper external surface extends radially past at least a portion of the lower external surface and the lower internal surface.

In other embodiments, the upper internal surface extends radially past the lower external surface.

In still other embodiments, the sump pump crock further comprises an internal shoulder between the upper internal surface and the lower internal surface.

In other embodiments, the one or more lower sidewalls have a plurality of perforations in at least one sidewall of the one or more lower sidewalls.

In further accord with embodiments, the body comprises a first portion having a first upper body and a first lower body, and a second portion having a second upper body and a second lower body. The first portion and the second portion are removably operatively coupled together. The first upper body and the second upper body form the upper body, and the first lower body and the second lower body form the lower body.

Other embodiments comprise a method of installing a sump pump crock. The sump pump crock having a body comprising an upper body having one or more upper sidewalls forming an upper opening and a lower body having one or more lower sidewalls and a base. The upper body comprises an upper external surface and an upper internal surface, and the lower body comprises a lower external surface and a lower internal surface. The upper external surface extends radially past at least a portion of the lower external surface and the lower internal surface. The method comprises installing the sump pump crock in an aperture in the ground having an opening that at least partially converges towards a bottom of the aperture such that the lower body of the sump pump crock is located in the aperture below the upper body of the sump pump crock.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention, and which are not necessarily drawn to scale, wherein.

DETAILED DESCRIPTION

Figure 1:
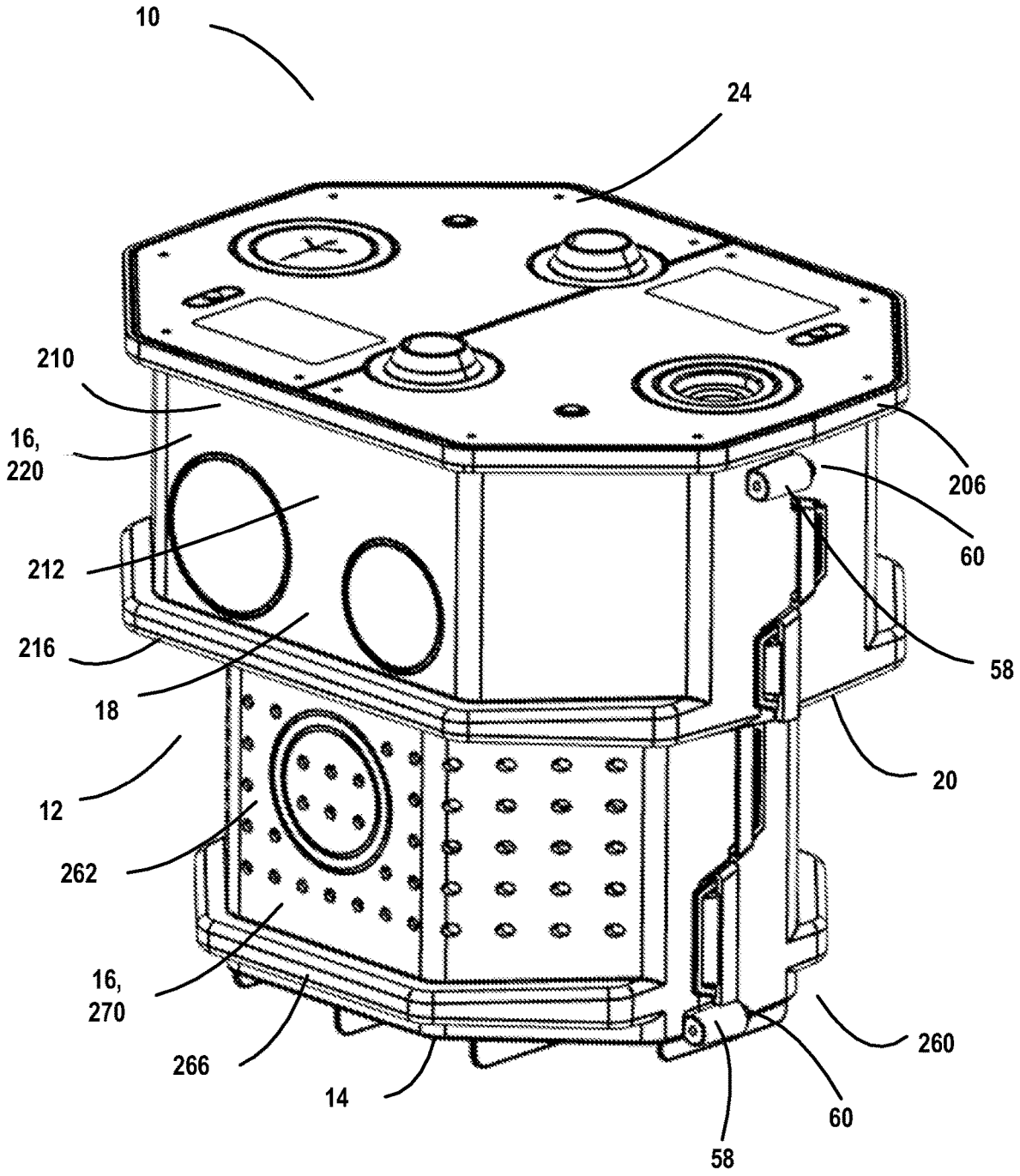
FIG. 1 illustrates a perspective view of a condensed sump pump crock, in accordance with some embodiments of the disclosure.

FIGS. 1 through 14B illustrate a sump pump crock 10 (e.g., otherwise described as a condensed sump pump crock), or components thereof. The sump pump crock 10 includes a body 12 including a base 14 and side walls 16. The body 12 includes a first portion 18 and a second portion 20 that are connected together to define the sump pump crock 10 to allow the sump pump crock 10 to be installed in very confined substructure areas, such as crawlspaces. For example, the separate components can be carried to a desired location, such as in the crawlspace. Once at the desired location, the first portion 18 and the second portion 20 are attached to form the body 12 with the base 14 and side walls 16. This allows the sump pump crock 10 to be transported in components to locations that are too tight to receive a one-piece sump pump crock. Moreover, the first portion 18 and the second portion 20 may or may not be the same. As such, in some embodiments, when the first portion 18 and second portion 20 are the same, manufacturing costs may be reduced because any two portions may be operatively coupled to each other to form the assembled sump pump crock 10. While the sump pump crock 10 is illustrated as having two portions, it should be understood that the sump pump crock 10 may have a body 12 formed from two or more portions (e.g., three, four, or the like). Furthermore, while the sump pump crock 10 is illustrated as being separated and assembled vertically, it should be understood that the sump pump crock 10 may be separated and assembled in any orientation, including horizontally (e.g., between the upper body 210 and lower body 260 described below).

Moreover, as illustrated in FIGS. 1 through 14B, the body 12 of the sump pump crock 10 may further have an upper body 210 and a lower body 260. The upper body 210 may have one or more upper sidewalls 220, which will be discussed in further detail herein, which forms the opening 22 (e.g., upper opening 22 of the sump pump crock 10). The lower body 260 may also have one or more lower sidewalls 270, which will be discussed in further detail herein. Moreover, the upper body 210 has an upper external surface 212 and an upper internal surface 214, while the lower body 260 has a lower external surface 262 and a lower internal surface 264. As illustrated in the figures, the upper external surface 212 extends radially past at least a portion of (e.g., a portion, a majority of, or the entirety of) the lower external surface 262 such that the sump pump crock 10 has a necked configuration in which the upper body 210 (e.g., head, or the like) extends past the lower body 260 (e.g., neck, or the like). Moreover, it should be understood that the upper internal surface 214 may also extend radially past at least a portion of (e.g., a portion, a majority of, or the entirety of) the lower internal surface 264, and in some embodiments radially past at least a portion of (e.g., a portion, a majority of, or the entirety of) the lower external surface 262 (e.g., depending on the thickness of the one or more upper sidewalls 220 and the one or more lower sidewalls 270). As illustrated in FIGS. 7-10, one or more shoulders 30 may be formed between the upper body 210 and the lower body 260. In some embodiments, the one or more shoulders 30 may be angled, at least partially, such that any water located on the one or more shoulders 30 is directed towards the lower body 260. In other embodiments, the one or more shoulders 30 may have ridges that allow water to flow towards the lower body 260. The one or more shoulders 30 may be the same or different sizes and/or may or may not extend from any of the one or more walls 16 (e.g., internal surfaces thereof, or the like) of the body 12.

The configuration of the upper body 210 and lower body 260 not only further allows the sump pump crock 10 to be more easily transported to confined locations, but it also allows for installation in narrower apertures (e.g., holes) in the ground (e.g., concreate floor, dirt floor, other material in the floor, or the like). For example, the reduced radial size of the lower body allows a user (e.g., installer, or the like) to form an aperture in the ground that is not as wide at the base of the aperture when compared to the upper portion of the aperture.

As illustrated in FIGS. 2A, 2B, 7, and 8-10, the sump pump crock 10 includes an opening 22 formed by the upper sidewalls 220, and/or a flange 26 as will be described below. Moreover, as illustrated in FIGS. 1, 2A, 5, 12, 14A, and 14B, a lid 24 is operatively coupled to the upper sidewalls 220 in order to at least partially cover the opening 22. In one example, the body 12 includes eight side walls 16 (on both the upper body 210 and the lower body 260) such that a cross-sectional shape of both the upper body 210 and the lower body 260 is substantially octagonal. However, it should be understood that the upper body 210 and/or the lower body 260 may be made of any number of sidewalls 16 to form any type of shape (e.g., circular, oval, square, rectangular, triangular, polygonal, curved, uniform, non-uniform, or the like shape). In some embodiments, as illustrated in the figures, since the body 12 is not round, the flat walls of the body 12 help to withstand hydrostatic and other soil pressures. It should also be understood that the sump pump crock 10 may be made of any material (e.g., metal, composite, plastic, or the like), but in some embodiments the body 12 and lid 24 are made of molded plastic.

The body 12, such as the side walls 16, may include one or more flanges 26 that provide anti-heaving features that withstand frost and other soil pressures and provide structural integrity. In the embodiments illustrated in the figures, the one or more flanges 26 comprise at least one top flange 206, at least one upper flange 216 and at least one lower flange 266. It should be understood that the one or more flanges 26 (e.g., the at least one top flange 206, the at least one upper flange 216, the at least one lower flange 266, or the like) may be located anywhere on the body 12 (e.g., anywhere on the upper body 210, the lower body 260, or the like). The one or more flanges 26 extend around at least a portion of the external surfaces (e.g., external upper and lower surfaces 212, 262) of the body 12 (e.g., upper body 210, lower body 260). As such, the one or more flanges 26 may be continuous around the body 12 or may be discontinuous (e.g., may be breaks in the flanges 26, such as where the first portion 18 meets the second portion 20 on the sides of the sump pump crock 10). The one or more flanges 26 may be at least substantially (e.g., generally) parallel to the base 14. However, the flanges 26 may be located at an angle with the respect to the base 14 and/or with respect to the horizonal orientation of the sump pump crock 10.

In the embodiments illustrated in the figures, the top flange 206 may define the opening 22 formed by the upper sidewalls 220 of the upper body 210. Moreover, the upper flange 216 may be located adjacent the bottom of the upper body 210 (e.g., near the transition from the upper body 210 to the lower body 266). Also, as illustrated in the figures, the lower flange 266 may be located adjacent the bottom of the lower body 266 (e.g., near the base 14). While the flanges 26 are illustrated in specific locations, it should be understood that the one or more flanges 26 may be located on different portions of the body 12 (e.g., different locations on the upper body 210, the lower body 260, or the like).

Figure 4:
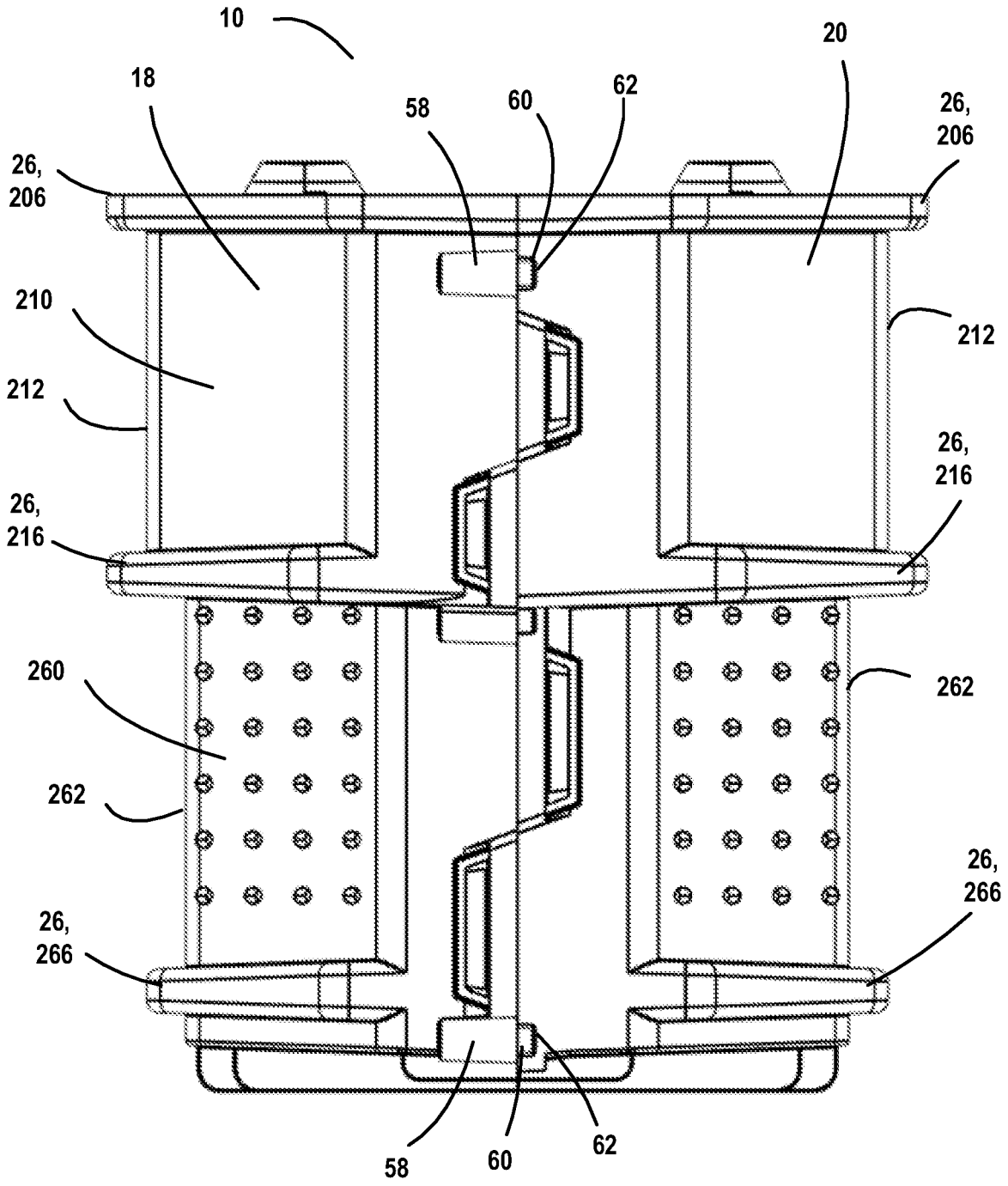
FIG. 4 illustrates a side view of the condensed sump pump crock, in accordance with some embodiments of the disclosure.
Figure 6:
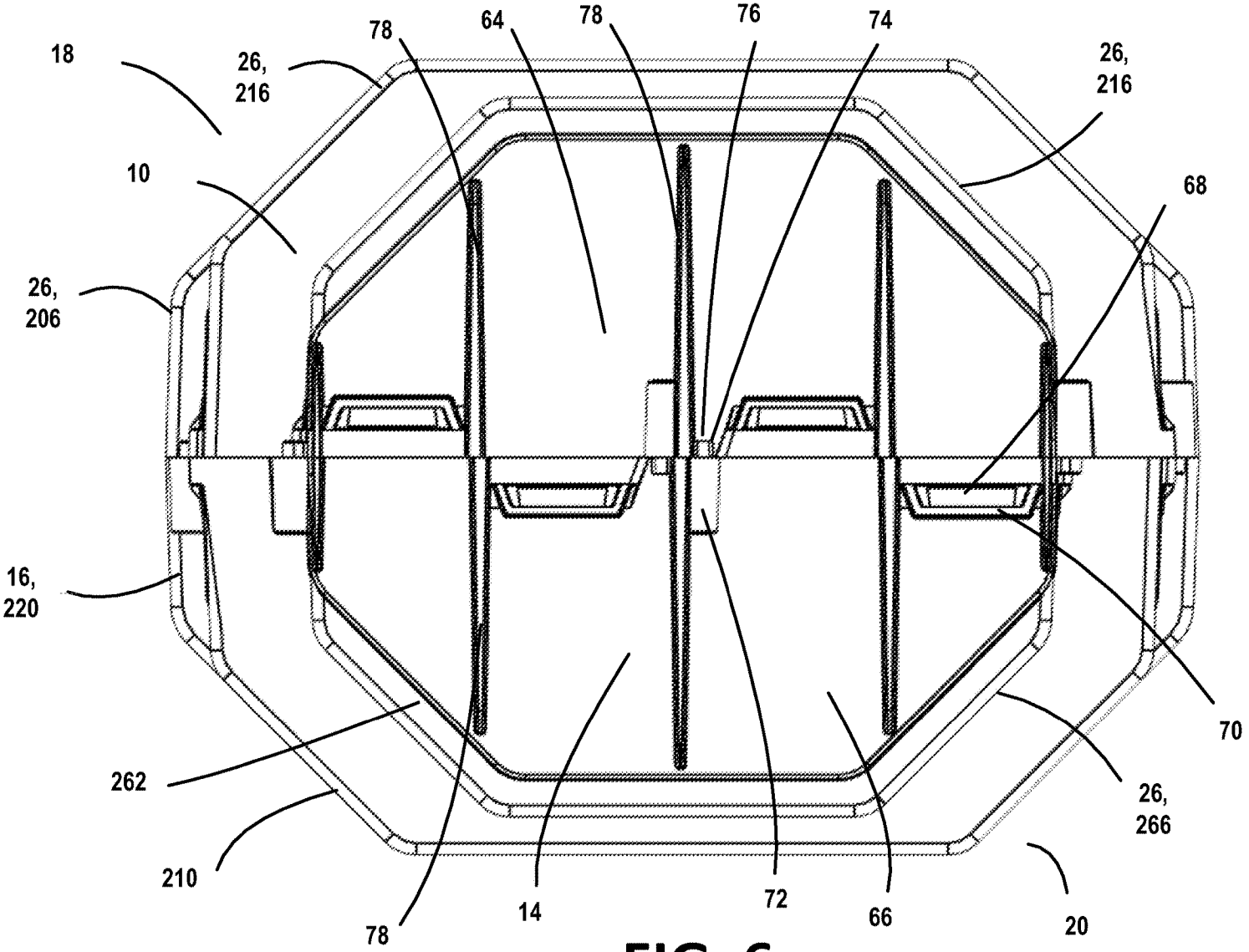
FIG. 6 illustrates a bottom view of the condensed sump pump crock, in accordance with some embodiments of the disclosure.

As further illustrated in FIGS. 4 and 6, the top flange 206 may extend past the upper external surface 212 of the upper body 210. As illustrated in FIG. 4, at least a portion of the top flange 206 and the upper flange 216 may extend the same distance past the external surface 212 of the upper body 210, such that the outer surface of at least a portion of the top flange 206 and the upper flange 216 may be located in the same plane. However, it should be understood that at least a portion of the top flange 206 may extend radially past the upper flange 216 in some embodiments of the invention. In other embodiments, as illustrated in FIG. 6, portions of the top flange 206 may be in the same plane as the upper flange 216 and portions of the top flange 206 may extend past the upper flange 216. As further illustrated in FIGS. 4 and 6, the upper flange 216 may extend radially past the lower flange 266. In some embodiments, at least a portion of the upper external surface 212 may extend radially past the lower flange 266. Alternatively, at least a portion of the lower flange 266 may extend radially such that it is in the same plane as at least a portion of the upper external surface 212 of the upper body 12.

The top flange 206 may extend approximately 0.75 to 1.0 inches outwardly from the upper side wall 220 and have a thickness of approximately 0.75 to 1.0 inches. The upper flange 216 may have a thickness of approximately 0.75 to 1.5 inches, extend approximately 0.75 to 1.0 inches outwardly from the upper side wall 220, and extend approximately 1.75 to 2.0 inches outwardly from the lower side wall 270. The lower flange 266 may have a thickness of approximately 0.75 to 1.5 inches and extend approximately 0.75 to 1.0 inches outwardly from the lower side wall 270. The flanges 26 may be roughly spaced equally along the height of the body 12.

Regardless of the configurations and the dimensions of the one or more flanges 26, the one or more flanges 26 provide anti-heave properties (e.g., aids in preventing the upward movement of a structure due to soils that expand and/or contract) when the sump pump crock 10 is installed in the ground and the ground experiences temperature gradients (e.g., freezing, un-freezing, cold, and/or hot temperature cycles).

The side walls 16 also include a plurality of perforations 28. The plurality of perforations 28 (e.g., apertures, holes, or the like) may be molded into the side walls 16. The perforations 28 allow for the flow of water into and out of the body 12 and help to secure stone and soil from passing through the sump pump crock 10, which aids in the stability of the sump pump crock 10. As illustrated in the figures, the plurality of perforations 28 may be located in at least one of the one or more lower sidewalls 270 of the lower body 260.

Figure 2A:
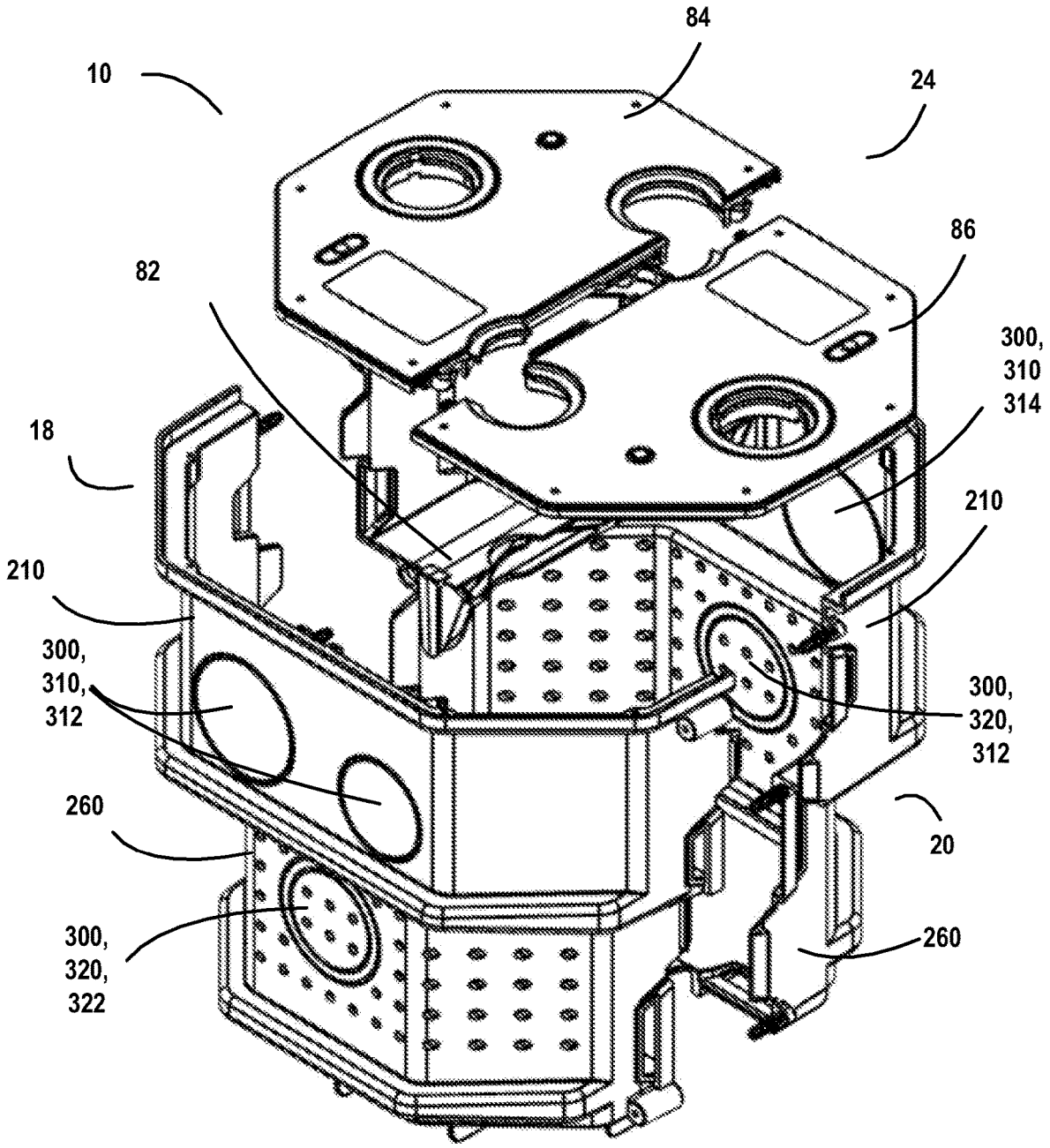
FIG. 2A illustrates an exploded perspective view of the condensed sump pump crock, in accordance with some embodiments of the disclosure.
Figure 2B:
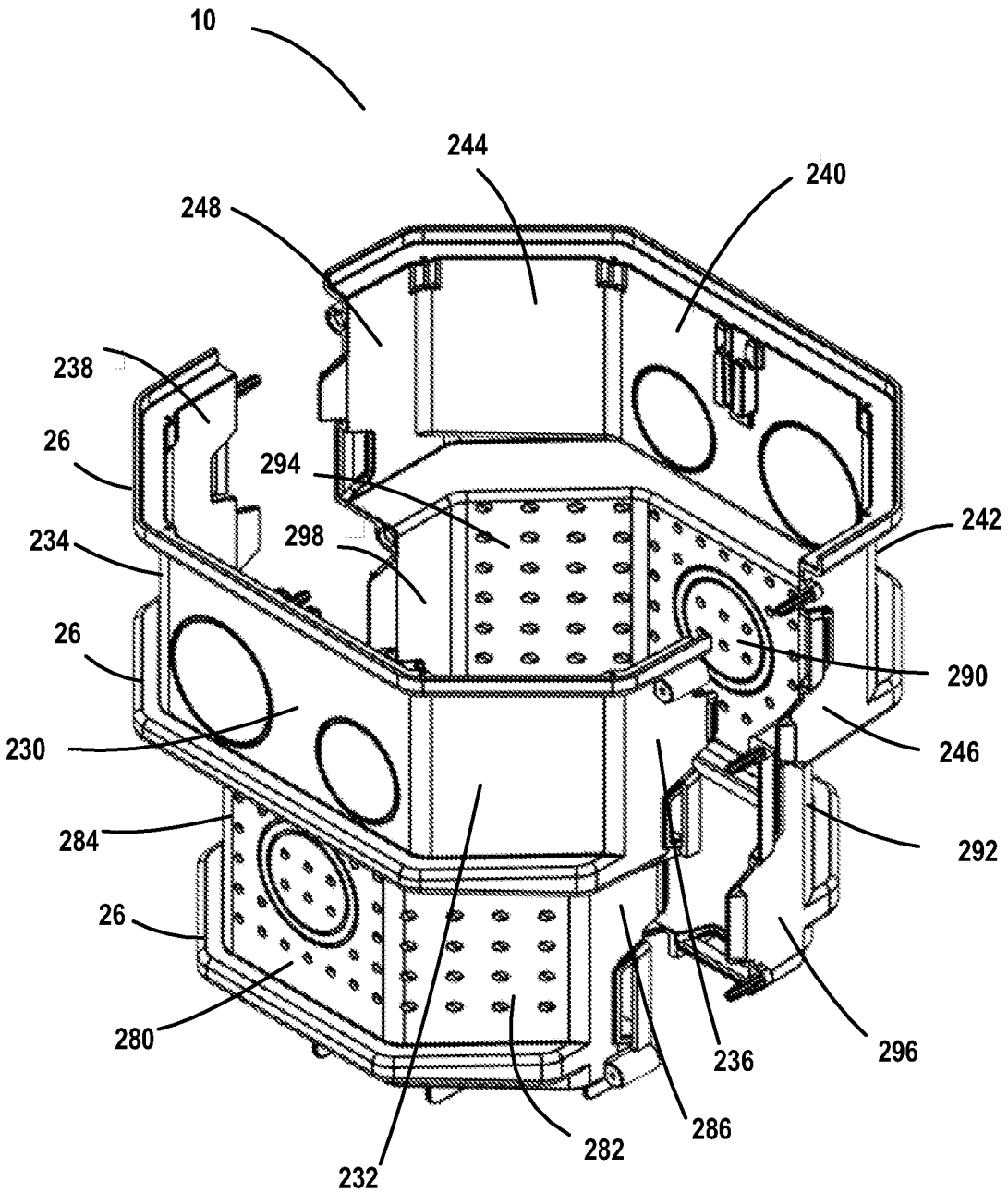
FIG. 2B illustrates an exploded perspective view of the first portion and second portion of the condensed sump pump crock, in accordance with some embodiments of the disclosure.
Figure 3:
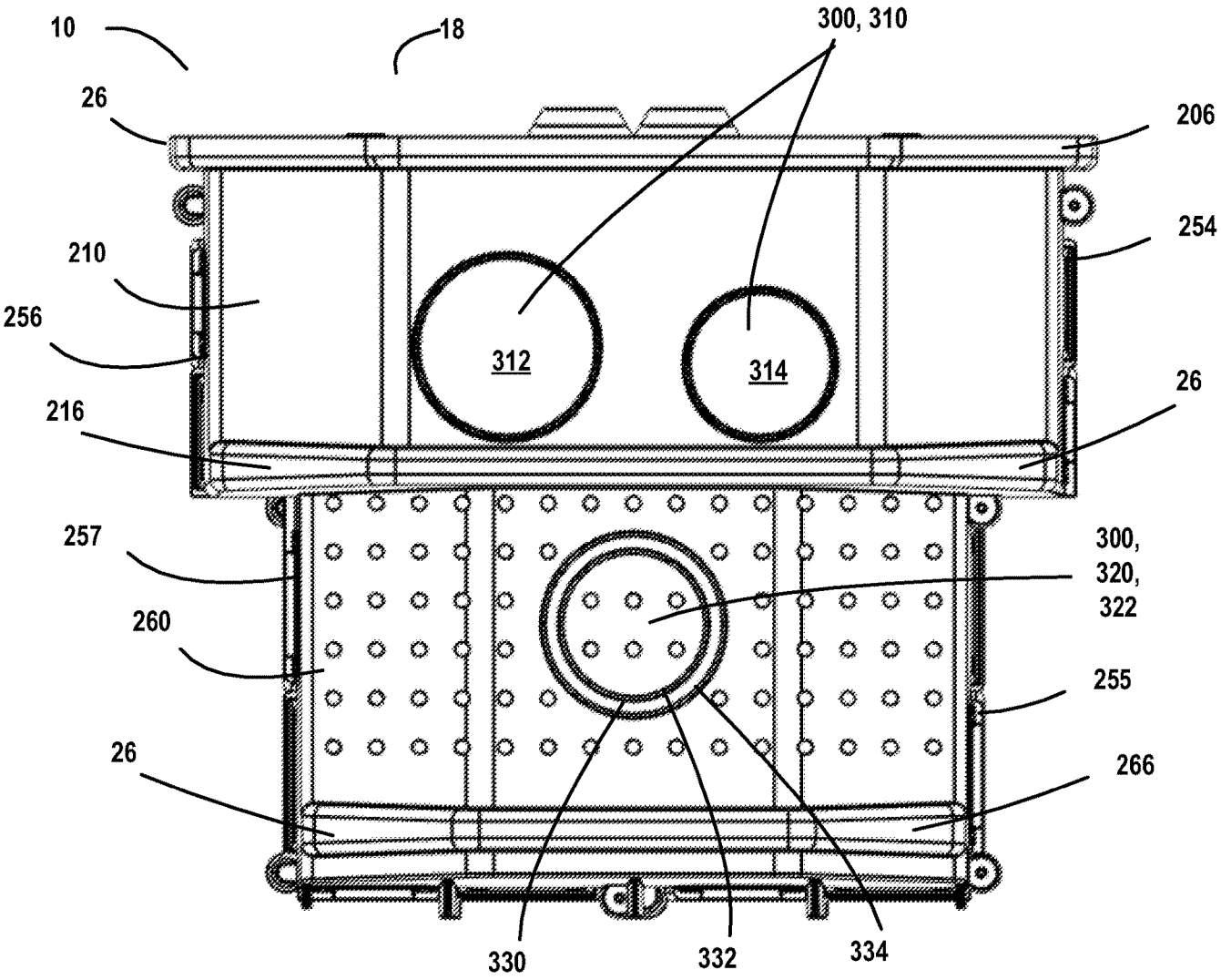
FIG. 3 illustrates a front view of the condensed sump pump crock, in accordance with some embodiments of the disclosure.
Figure 7:
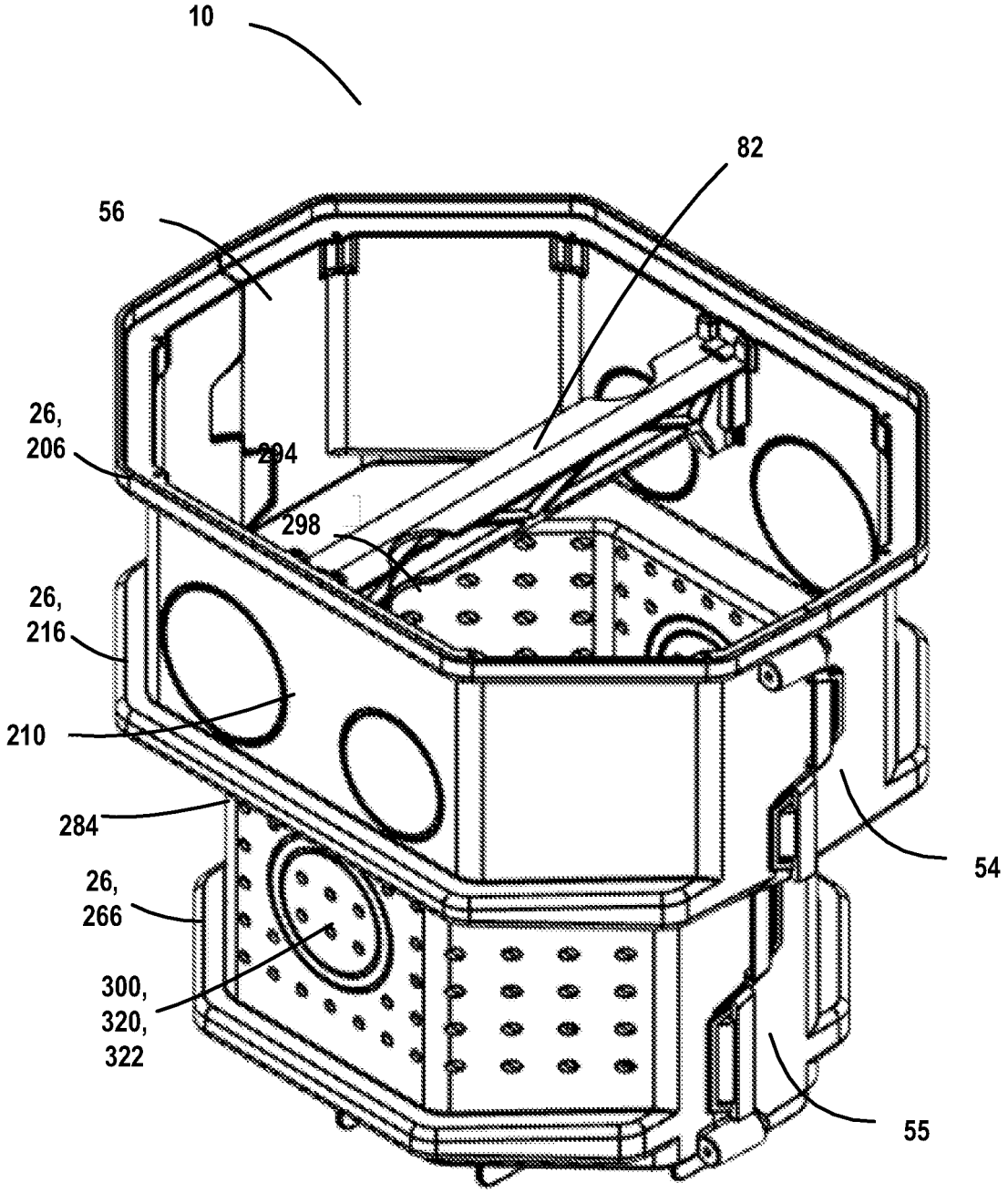
FIG. 7 illustrates a perspective view of the condensed sump pump crock with the lid removed, in accordance with some embodiments of the disclosure.
Figure 8:
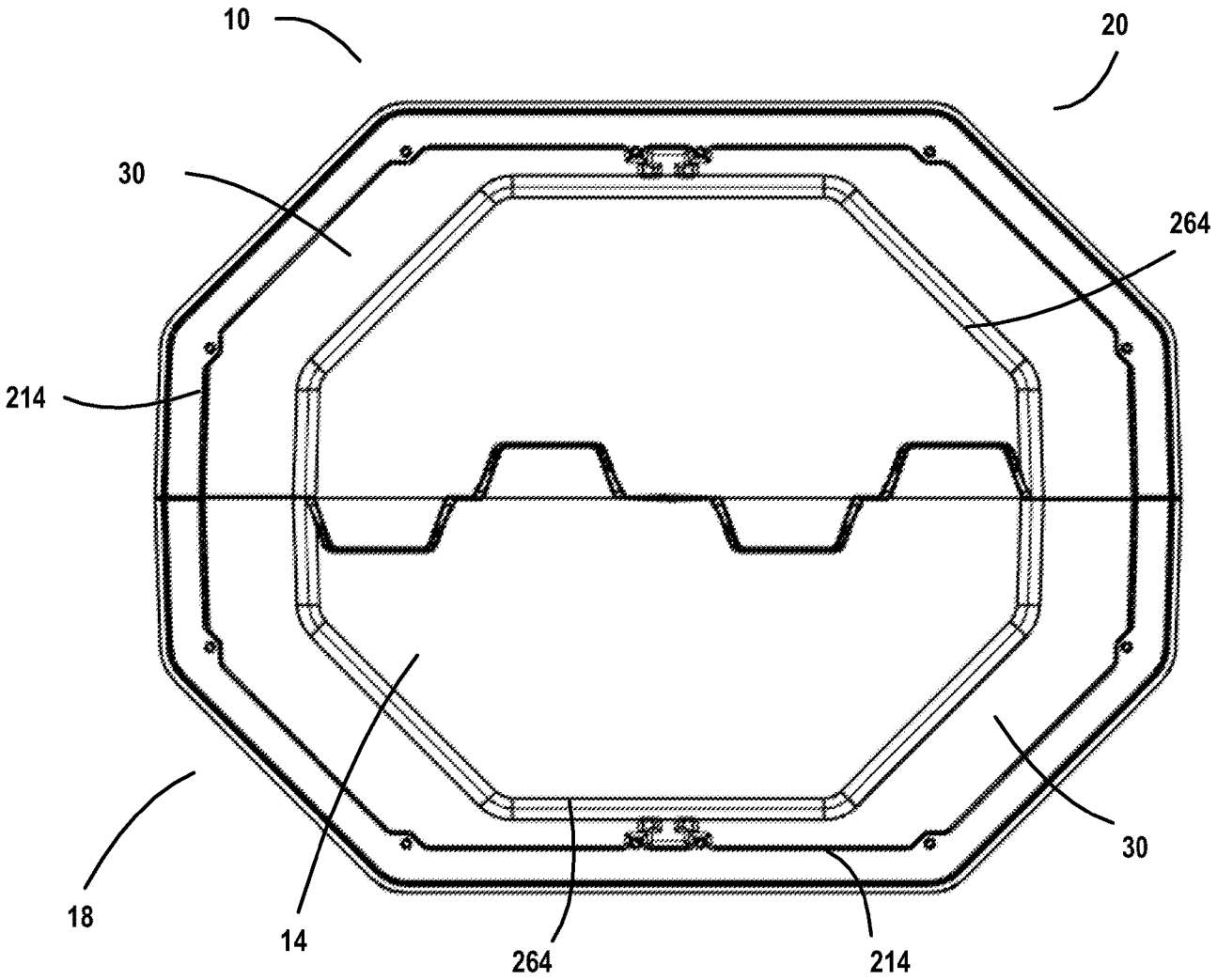
FIG. 8 illustrates a top view of the condensed sump pump crock with the lid and the support member removed, in accordance with some embodiments of the disclosure.
Figure 9:
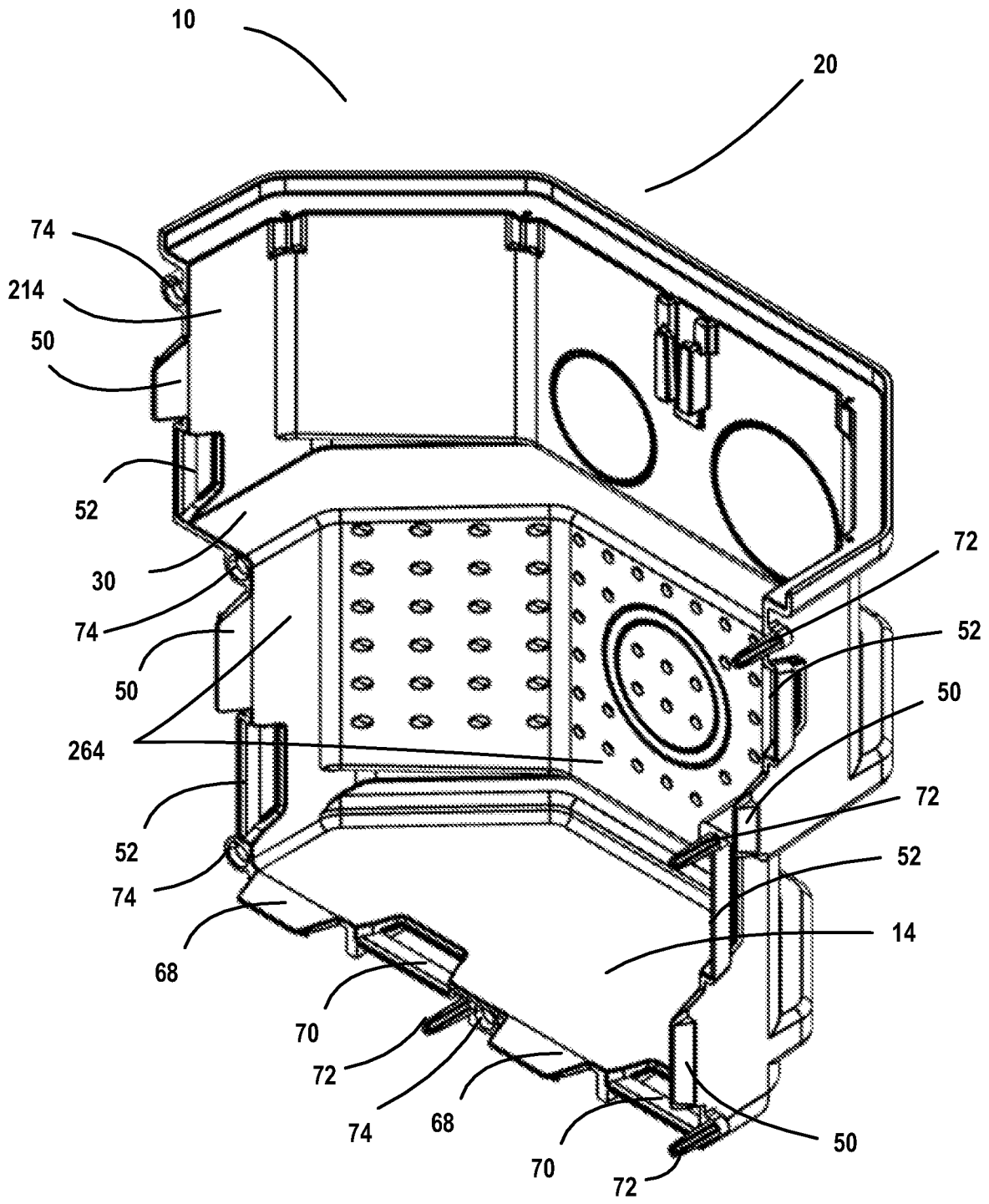
FIG. 9 illustrates a perspective view of the second portion of the condensed sump pump crock, in accordance with some embodiments of the disclosure.
Figure 10:
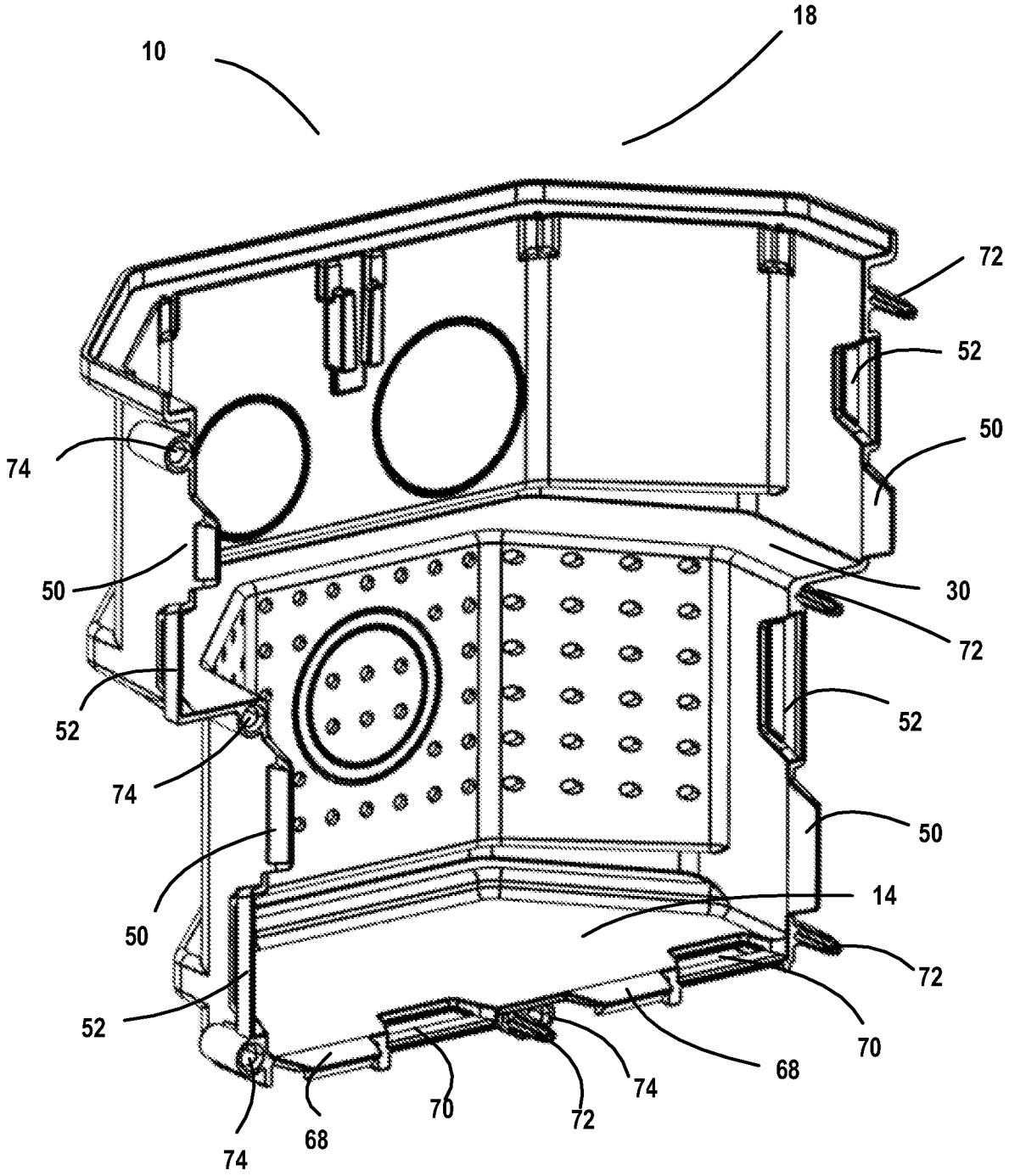
FIG. 10 illustrates a perspective view of the first portion of the condensed sump pump crock, in accordance with some embodiments of the disclosure.
Figure 11:
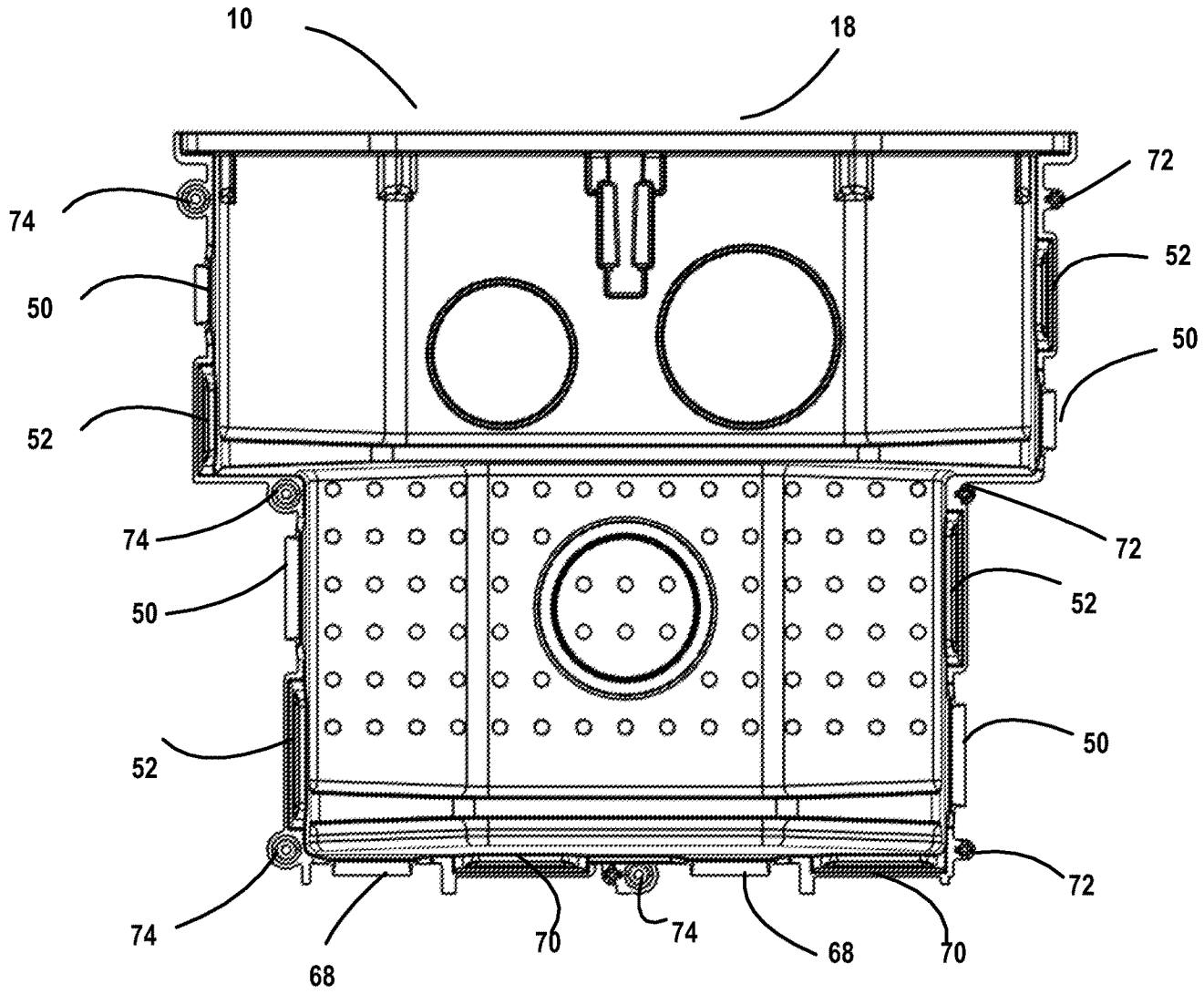
FIG. 11 illustrates an internal front view of the second portion of the condensed sump pump crock, in accordance with some embodiments of the disclosure.

As illustrated in FIGS. 2A, 3, and 7, one or more ports 300 may be located in the body 12 of the sump pump crock 10. As illustrated in the figures, the upper body 210 may include one or more upper ports 310, such as one or more first upper ports 312 on the first portion 18 of the upper body 210 and one or more second upper ports 314 on the second portion 20 of the upper body 210. Moreover, the lower body 210 may include one or more lower ports 320, such as one or more first lower ports 322 on the first portion 18 of the lower body 260 and one or more second lower ports 334 on the second portion 20 of the lower body 260. There may be ports located on both the first portion 18 and the second portion 20 of the sump pump crock 10 to allow for installation of the crock in any orientation. It should be understood that due to the condensed height of the sump pump crock 10, one or more lower ports 320 are located within the lower body 260 to provide a lower location for the attachment of other components (e.g., perimeter drain connector, or the like) to the one or more lower ports 320. For example, it should be understood that by providing one or more lower ports 320 in the lower body 210 longer runs of perimeter drains may be connected to the sump pump crock 10 (e.g., provides greater rise to allow for longer runs).

The one or more ports 300 may be removeable ports. In some embodiments the one or more ports 300 may be destructively removed (e.g., cut, punched, twisted, or the like) out of the sidewalls 220, 270 of the upper body 210 and/or the lower body 260. Alternatively, the one or more ports 300 may be detached and/or reinstalled (e.g., screwed, snapped, or the like) to the upper body 210 and/or the lower body 260. As illustrated in the figures, the one or more ports 300 (e.g., the one or more lower ports 320) may be removable to create different sized openings in the sidewalls 16. For example, two or more grooves 330 (e.g., concentric grooves, or the like) may be located in the sidewalls 16 that can be removed to create different sized opening ports (e.g., an inner groove 332, an outer groove 334, or the like).

With respect to the sidewalls 16 of the sump pump crock 10, in the embodiments illustrated in the figures (e.g., in FIG. 2B), the upper body 210 of first portion 18 includes a first upper wall 230, a second upper wall 232 connected to the first upper wall 230 at approximately a 45° angle relative to the first upper wall 230, and a third upper wall 234 connected to the first upper wall 230 at approximately a 45° angle relative to the first upper wall 230. A partial fourth upper wall 236 is connected to the second upper wall 232 at approximately a 45° angle (and approximately perpendicular to the first upper wall 230), and a partial fifth upper wall 238 is connected to the third upper wall 234 at approximately a 45° angle (and approximately perpendicular to the first upper wall 230).

Moreover, the upper body 260 of the second portion 20 includes a sixth upper wall 240 (parallel to the first upper wall 230 when the portions 18, 20 are assembled), a seventh upper wall 242 connected to the sixth upper wall 240 at approximately a 45° angle relative to the sixth upper wall 240 (and approximately parallel to the third upper wall 234 when the portions 18, 20 are assembled), and an eighth upper wall 244 connected to the sixth upper wall 240 at approximately a 45° angle relative to the sixth upper wall 240 (and approximately parallel to the second upper wall 232 when the portions 18, 20 are assembled). A partial fourth upper wall 246 is connected to the seventh upper wall 242 at approximately a 45° angle (and approximately perpendicular to the sixth upper wall 240), and a partial fifth upper wall 248 is connected to the eighth upper wall 244 at approximately a 45° angle (and approximately perpendicular to the sixth upper wall 240).

It should be understood that the lower body 260 may have a similar configuration. As such, the lower body 260 of the first portion 18 includes a first lower wall 280, a second lower wall 282 connected to the first lower wall 280 at approximately a 45° angle relative to the first lower wall 280, and a third lower wall 284 connected to the first lower wall 280 at approximately a 45° angle relative to the first lower wall 280. A partial fourth lower wall 286 is connected to the second lower wall 282 at approximately a 45° angle (and approximately perpendicular to the first lower wall 280), and a partial fifth lower wall 288 is connected to the third lower wall 284 at approximately a 45° angle (and approximately perpendicular to the first lower wall 280).

Moreover, the upper body 260 of the second portion 20 includes a sixth lower wall 290 (parallel to the first lower wall 280 when the portions 18, 20 are assembled), a seventh lower wall 292 connected to the sixth lower wall 290 at approximately a 45° angle relative to the sixth lower wall 290 (and approximately parallel to the third lower wall 284 when the portions 18, 20 are assembled), and an eighth lower wall 294 connected to the sixth lower wall 290 at approximately a 45° angle relative to the sixth lower wall 290 (and approximately parallel to the second lower wall 282 when the portions 18, 20 are assembled). A partial fourth lower wall 296 is connected to the seventh lower wall 292 at approximately a 45° angle (and approximately perpendicular to the sixth lower wall 290), and a partial fifth lower wall 298 is connected to the eighth lower wall 294 at approximately a 45° angle (and approximately perpendicular to the sixth lower wall 290).

The partial fourth upper and lower walls 236, 246, 286, 296 and the partial fifth upper and lower walls 238, 248, 288, 298 of the upper and lower bodies 210, 260 of the first portion 18 and the second portion 20, respectively, may include alternating tabs 50 and receptacles 52 (e.g, tab receptacles). Each tab 50 on the partial fourth upper and lower walls 236, 286 and partial fifth upper and lower walls 238, 288 of the first portion 18 is received in a receptacle 52 on the partial fourth upper and lower walls 246, 296 and partial fifth upper and lower walls 248, 298, respectively, of the second portion 20. Each tab 50 on the partial fourth upper and lower walls 246, 296 and partial fifth upper and lower walls 248, 298 of the second portion 20 is received within a receptacle 52 on partial fourth upper and lower walls 236, 286 and partial fifth upper and lower walls 238, 288, respectively, of the first portion 18.

In one example, there are two tabs 50 and two receptacles 52 on the partial fourth upper and lower walls 236, 286 of the first portion 18 that engage with and lock with respect to two tabs 50 and two receptacles 52 on the partial fourth upper and lower walls 246, 296 of the second portion 20. There are also two tabs 50 and two receptacles 52 on the partial fifth upper and lower walls 238, 288 of the first portion 18 that engage with and lock with respect to two tabs 50 and two receptacles 52 on the partial fifth upper and lower walls 248, 298 of the second portion 20.

Figure 13A:
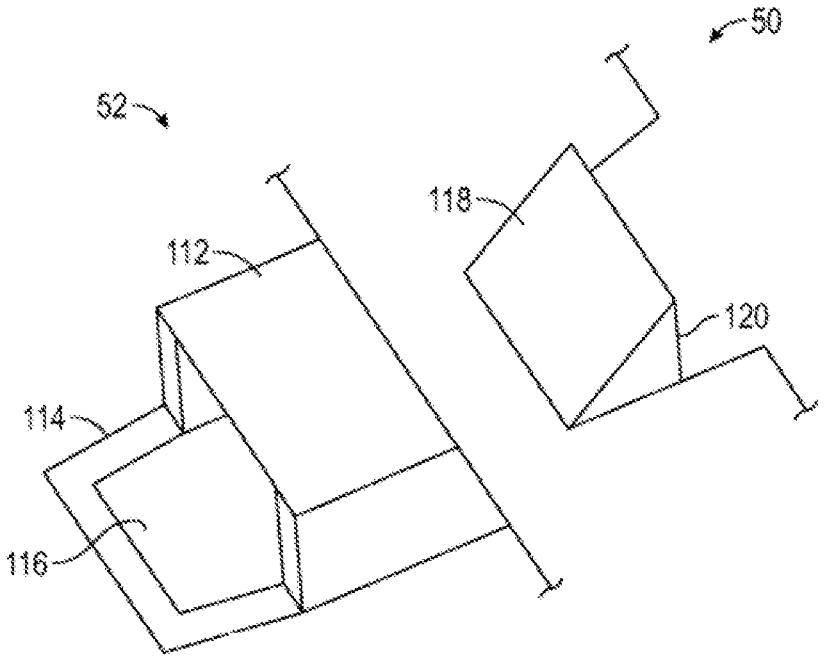
FIG. 13A illustrates a tab and a receptacle unattached, in accordance with some embodiments of the disclosure.
Figure 13B:
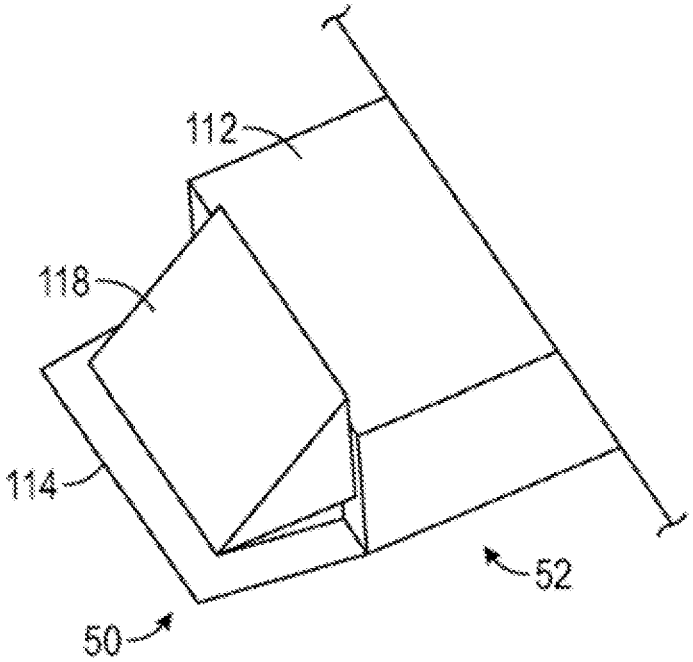
FIG. 13B illustrates a tab and a receptacle attached, in accordance with some embodiments of the disclosure.

As shown in FIGS. 13A and 13B, in one example, each tab 50 includes a wall 120 approximately perpendicular to the body 12 and a raised inclined portion 118 that defines a latch. As shown in FIG. 13A, each receptacle 52 is defined by a bracket 112 having a spaced ledge 114 that defines a space 116 in which the tab 50 is received. During insertion, the raised inclined portion 118 of the tab 50 is pressed underneath the bracket 112, compressing the raised inclined portion 118 of the tab 50. As shown in FIG. 13B, once the tab 50 passes under the bracket 112 that defines the space 116, the compression on the raised inclined portion 118 of the tab 50 is released. The tab 50 is received in the space 116 defined by the ledge 114, and the wall 120 of the tab 50 engages a side of the bracket 112, securing the first portion 18 to the second portion 20. Each tab 50 and opening 52 pair is attached in this manner. The first portion 18 and the second portion 20 can also be detached from each other by pressing on the tab 50 to allow the tap 50 to slide out of the receptacle 52.

When attached, the partial fourth upper wall 236 of the first portion 18 and the partial fourth upper wall 246 of the second portion 20 define a fourth upper wall 254, and the partial fourth lower wall 286 of the first portion 18 and the partial fourth lower wall 296 of the second portion 20 define a fourth lower wall 255. Alternatively, the partial fifth upper wall 238 of the first portion 18 and the partial fifth upper wall 248 of the second portion 20 define the fifth upper wall 256, and the partial fifth lower wall 288 of the first portion 18 and the partial fifth upper wall 298 of the second portion 20 define the fifth lower wall 257. In some embodiments, the fourth upper wall 254 is at least approximately parallel to the fifth upper wall 256. The fourth lower wall 255 is at least approximately parallel to the fifth lower wall 257.

It should be understood, that while the upper body 210 and the lower body 260 are illustrated and described as have as having eight walls (when assembled) at particular angles from each other, it should be understood that the upper body 210 and/or lower body 260 may have the same or a different number of walls at different angles. Moreover, it should be understood that the upper body 210 and lower body 260 may have any type of shape having any number of walls (e.g., single curved walls, multiple curved walls, curved and angled walls, or the like). Furthermore, while the walls 16 of the upper body 210 and the lower body 260 are illustrated as being generally vertical (e.g., as the sump pump crock 10 would be installed), it should be understood that the walls 16 of the upper body 210 and/or the lower body 260 may converge from the top (e.g., near the lid 24) of the sump pump crock 10 towards the bottom (e.g., near the base 14) of the sump pump crock 10.

Moreover, in some embodiments, the first portion 18 and the second portion 20 each include a plurality of aligned tubes 58 and 60 (e.g., male and female tubes, or the like), respectively. A threaded fastener 62, such as a screw, may be received in each set of aligned tubes 58 and 60 to secure the first portion 18 and the second portion 20 together. In some embodiments, the fasteners may be pre-secured within the first portion 18 and second portion 20 to aid in preventing an installer from losing the fasteners.

As further illustrated in the figures, the first portion 18 includes a first base part 64, and the second portion 20 includes a second base part 66. The first base part 64 and the second base part 66 may each include a plurality of alternating tabs 68 and receptacles 70. Each tab 68 on the first base part 64 is received in one of the openings 70 on the second base part 66, and each tab 68 on the second base part 66 is received in one of the openings 70 on the first base part 64. The tabs 68 and the receptacles 70 are attached as described above with respect to FIGS. 13A and 13B.

In one example, each tab 68 includes a wall approximately perpendicular to the base 14 and a raised inclined portion that defines a latch. Each receptacle 70 is defined by a bracket having a spaced ledge that defines a space in which the tab 68 is received. During insertion, the raised inclined portion of the tab 68 is pressed underneath the bracket, compressing the raised inclined portion of the tab 68. Once the tab 68 passes under the bracket that defines the space, the compression on the raised inclined portion of the tab 68 is released. The tab 68 is received in the space defined by the ledge, and the wall of the tab 68 engages a side of the bracket, securing the first base part 64 to the second base part 66 to define the base 14. Each tab 68 and receptacle 70 pair is attached in this manner.

The first base part 64 and the second base part 66 each include aligned tubes 72, 74, respectively. A threaded fastener 76, such as a screw, may be received in the aligned tubes 72, 74 (e.g., male and female tubes) to secure the first base part 64 and the second base part 66 together. The base 14 may include a plurality of flanges 78. In one example, the flanges 78 are approximately parallel and extend between the first lower wall 280 and the sixth lower wall 290.

In some embodiments, the fasteners 62, 78 may be pre-secured within one or more of the tubes 58, 60, 72, 74 of the first portion 18 and/or the second portion 20 to aid in preventing an installer from losing the fasteners. In other embodiments, the fasteners may be other types of fasteners such as bolts, nuts, rivets, clips, hooks, bands, or the like.

While the first portion 18 and second portion 20 are described as being operatively coupled through the use of tabs and receptacles, aligned tubes 58, 60, 72, 74, and/or fasteners 62, 78, it should be understood that alternatively, or additionally, the first portion 18 and the second portion 20 may be operatively coupled through other members, such as projections and grooves, or the like.

As shown in FIGS. 7 through 11, the inside surface of the upper body 210, such as the first upper wall 230 and the sixth upper wall 240, may include a slot 80 that receives a support member (e.g., bridge 82, or the like) that extends between two locations within the upper body 210, such as between the first upper wall 230 and the sixth upper wall 240. The bridge 82 may be used to increase the strength of the sump pump crock 10. In other embodiments, the bridge 82 may be operatively coupled to the upper body 210 of the sump pump crock 10 in other ways, such as but not limited to fasteners, snap-fit, or the like.

Figure 5:
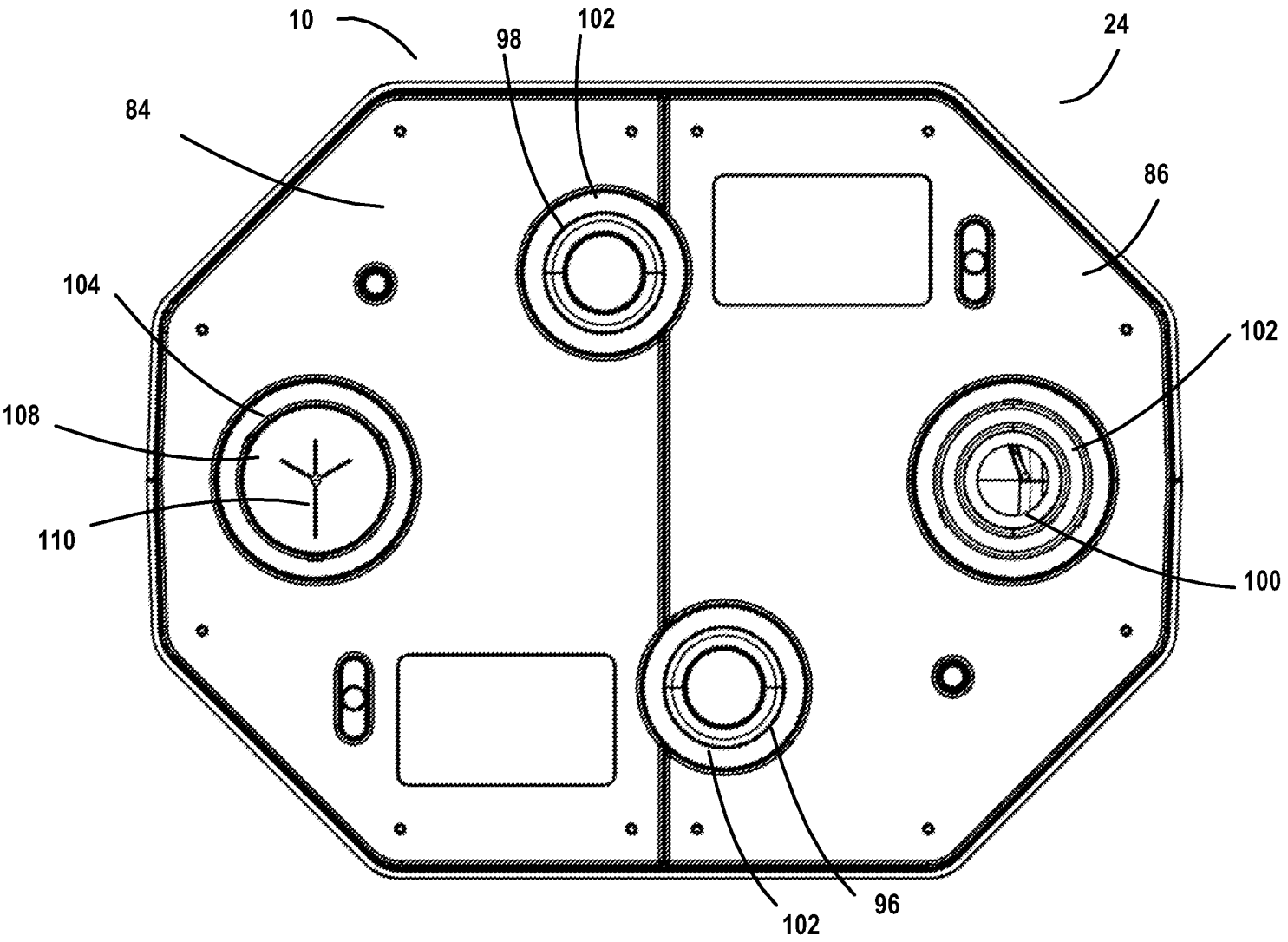
FIG. 5 illustrates a top view of the condensed sump pump crock with the lid, in accordance with some embodiments of the disclosure.
Figure 12:
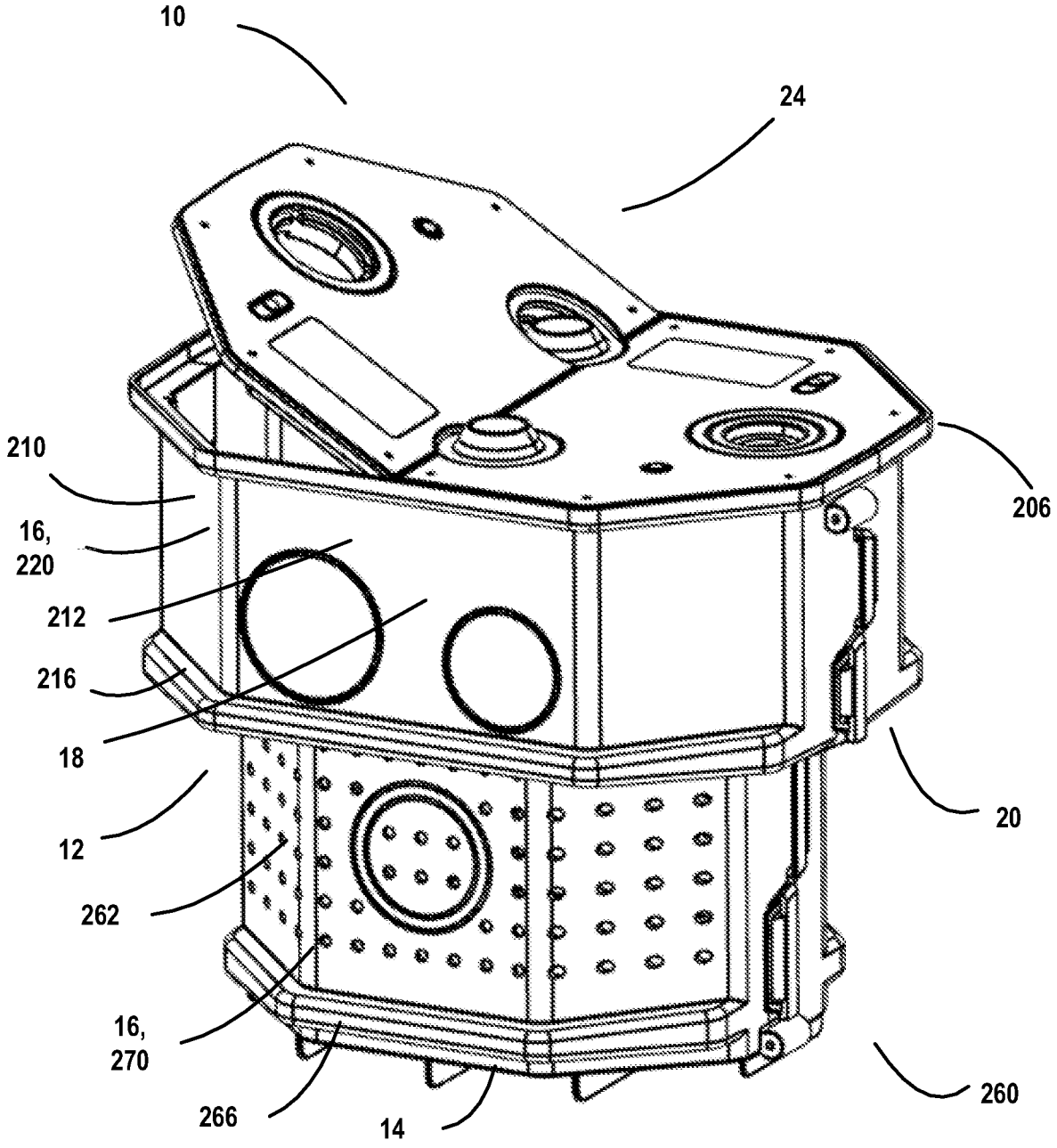
FIG. 12 illustrates a perspective view of the condensed sump pump crock with a portion of the lid open, in accordance with some embodiments of the disclosure.
Figure 14A:
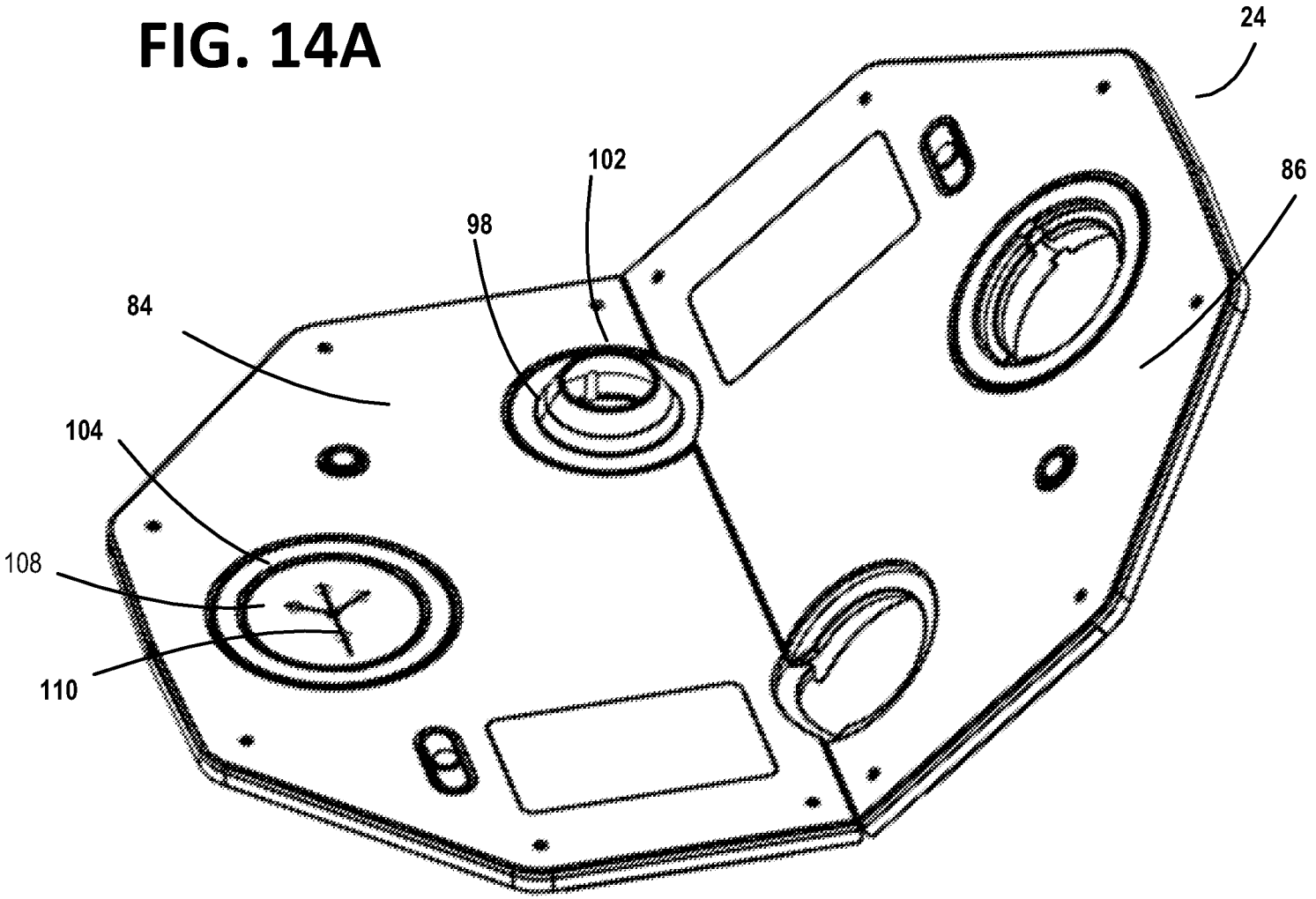
FIG. 14A illustrates a top perspective view of the portions of the lid rotated with respect to each other, in accordance with embodiments of the present disclosure.
Figure 14B:
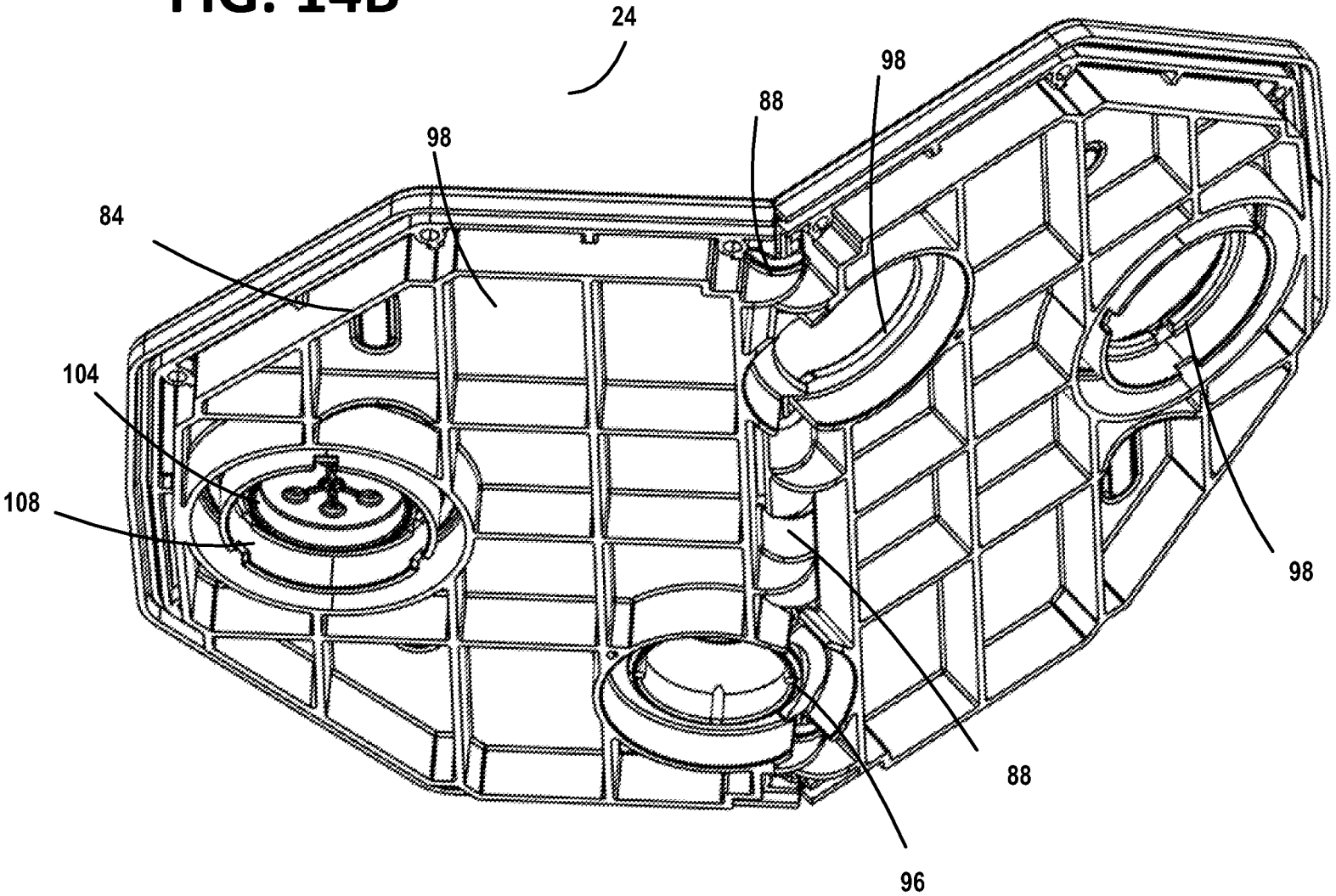
FIG. 14B illustrates a bottom perspective view of the portions of the lid rotated with respect to each other, in accordance with embodiments of the present disclosure.

As shown in FIGS. 5, 12, 14B, and 14B, the lid 24 includes a first lid portion 84 and a second lid portion 86. As shown in FIGS. 14A and 14B, the first lid portion 84 and the second lid portion 86 may rotate with respect to each other. In some embodiments the first lid portion 84 and the second lid portion 86 may each include a curved hinge 88 and a rod 90. The curved hinge 88 of the first lid portion 84 engages the rod 90 of the second lid portion 86, and the curved hinge 88 of the second lid portion 86 engages the rod 90 of the first lid portion 84. This allows the first lid portion 84 and the second lid portion 86 to pivot relative to each other. For example, when the lid 24 is placed over the opening of the body 12, one of the lid portions 84, 86 can be lifted by pivoting one lid portion relative to the other lid portion. In another example, one of the lid portions 84, 86 can be removed by pivoting one of the lid portions relative to the other lid portions. While the rotation of the first lid portion 84 and the second lid portion 86 is described as being aided by the curved hinge 88 and the rod 90, it should be understood that other couplings may be used to allow for the rotation and/or removal of one lid portion with respect to the other. In other embodiments, the lid portions may be separate portions that are removable and/or installable separately. In other embodiments, any type of lid may be utilized with the body 12 of the sump pump crock 10.

The lid 24 may include a groove 92 that runs around a perimeter of the lid 24. A seal (not shown) may be received in the groove 92 to provide sealing of gases. The lid 24 may further include a plurality of flanges 94 to provide support. The lid 24 has a shape that corresponds to the shape of the opening 22.

The lid 24 may further comprise a plurality of apertures 96, 98, 100, and 102 (e.g., pre-formed, or created by removing a portion of the lid, or the like). A first hole 96, a second hole 98, and a third hole 100 may receive a gasket/seal 102, and a tube (not shown) of a sump pump system in the gasket/seal 102 to provide sealing. A fourth hole 104 may receive a drain 106. While specific apertures and locations of the apertures are illustrated, it should be understood that any number of apertures may be located in any number of locations within the lid 24.

The drain 106 may include a flexible body that extends into the body 12 of the sump pump crock 10 and provides a seal that allows water to flow in one direction into the body 12, but prevents bugs, rocks, or the like from entering the body 12. A rubber seal 108 with a plurality of slots 110 may be is received in the hole over the drain, as shown in FIG. 5.

Figure 15:
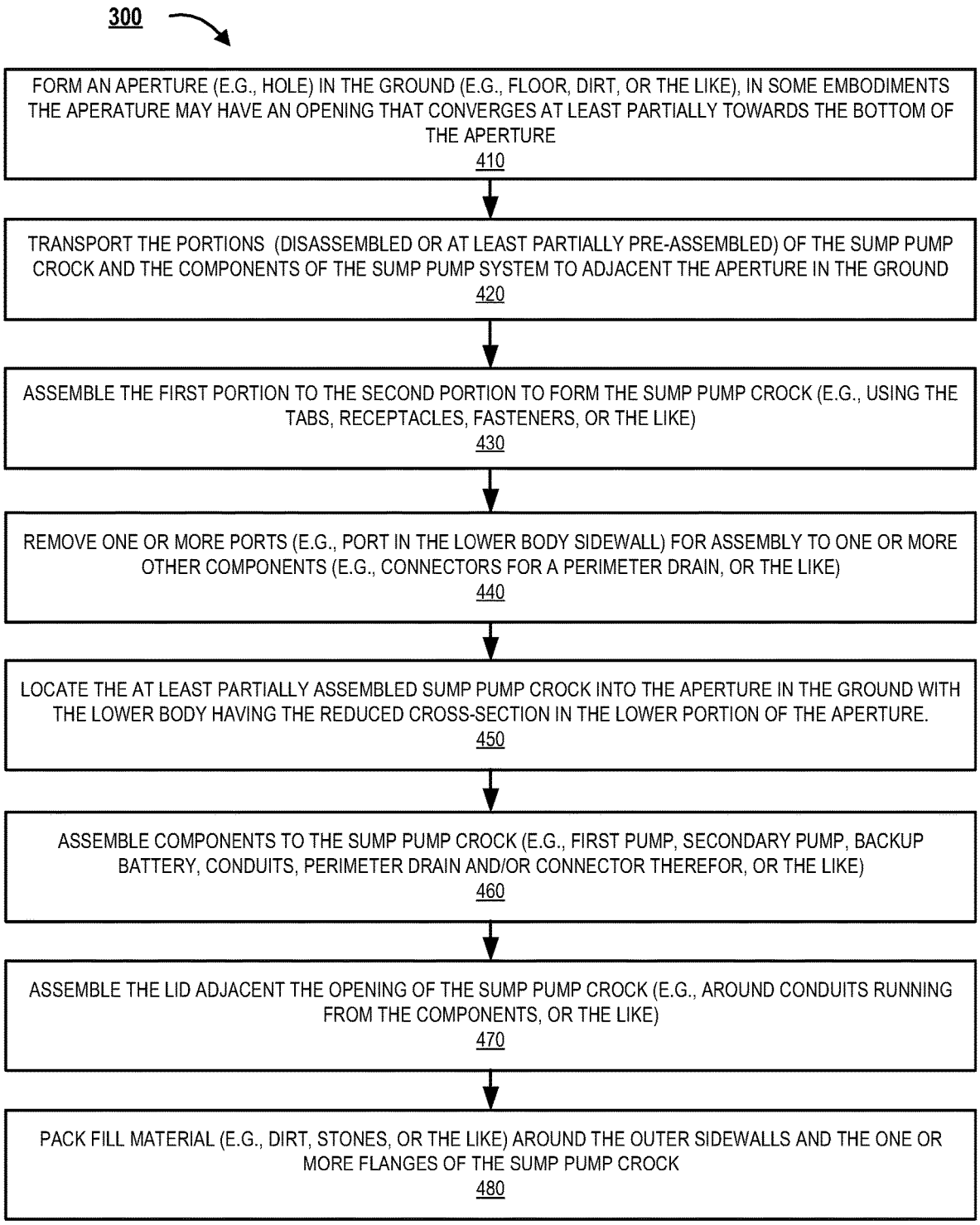
FIG. 15 illustrates a method of installing the condensed sump pump crock, in accordance with embodiments of the disclosure.

FIG. 15 illustrates a method of installing the condensed sump pump crock 10 described herein. As illustrated by block 410 of FIG. 15, a user (e.g., installer, or the like) may form a sump pump crock aperture (e.g., hole, or the like) in the ground. Due to the configuration of the sump pump crock 10 described herein, the aperture may have an opening at the top that converges, at least partially, (e.g., at lest some portion of the aperture) towards the bottom of the aperture. It should be understood that the aperture may be formed in the dirt, in concrete within a basement or other foundation, and/or any other feature in the ground.

FIG. 15 further illustrates in block 420 that portions of the sump pump crock 10 (e.g., disassembled, partially disassembled, or the like) are transported adjacent to the location of the aperture in the ground. Due to the ability of the sump pump crock 10 to be disassembled and/or the reduced size of the body 12 (e.g., in particular, the lower body 260), the sump pump crock 10 may be transported more easily to apertures in confined locations (e.g., in crawl spaces, under floors with low clearance, in basements with low clearances, or the like).

Block 430 of FIG. 15 illustrates that the user may assemble the portions (e.g., first portion 18, second portion 20, or the like and/or components thereof) of the sump pump crock 10 into an assembled sump pump crock 10.

FIG. 15 further illustrates in block 440 that the one or more ports 300 of the sump pump crock 10 are removed (e.g., destructively, non-destructively, or the like). For example, one or more of the lower ports 320 may be removed in order to operatively couple the sump pump crock 10 to another component (e.g., a perimeter drain, or the like).

Block 450 of FIG. 15 illustrates that the assembled sump pump crock 10 is at least partially located within the aperture in the ground. The lower body 260 of the sump pump crock 10 having the reduced cross-sectional area (e.g., when compared to the upper body 210) is located in the lower portion of the aperture having a cross-sectional area that is less than the cross-sectional area of the upper portion of the aperture (e.g., opening of the hole, or the like).

FIG. 15 further illustrates in block 460 that the sump pump components (e.g., a first pump, a backup second pump, a battery, conduits, perimeter drain, or the like) are assembled into and/or to the sump pump crock 10.

Block 470 further illustrates that the lid 24 is assembled adjacent the opening 22 of the sump pump crock 10 (e.g., within the opening created by top flange 206, around the conduits running from the components, and/or the like).

FIG. 15 further illustrates in block 480 that fill material (e.g., stones, dirt, or the like) is filled within the aperture in the ground (e.g., packed back around the sump pump crock). The fill material is secured around the outer sidewalls 16 and/or the one or more flanges 26 of the sump pump crock 10.

As described herein, the features of the sump pump crock 10 provide improvements to the operation and installation of the sump pump crock 10. For example, the smaller basin, in particular the lower body 260 (e.g., necked area) of the sump pump crock 10, allows an installer to be able to dig a smaller aperture in the ground for installation of the sump pump crock 10. As such, the installation process for a user is quicker and easier. Furthermore, as well as being able to split the body 12, the smaller basin, in particular the lower body 260 (e.g., necked area), allows the portions of the sump pump crock 10 to be transported to confined areas. Moreover, while the basin may be smaller, the basin is still able to fit all of the components (e.g., primary pump, secondary pump, back-up battery, and/or the like) of a larger sump pump crock, and is also to pump the same amount of water as a larger sump pump crock (e.g., have the same volume and/or area of perforations in the lower body 12 as provided in the entire body of larger sump pump crocks). Moreover, the sump pump crock 10 also has one or more ports 300 located in the lower body 260, which allows for attachment of other components (e.g., perimeter drain to provide the same, or an improvement to, the length of perimeter drains that can be attached to the sump pump). Without the improvements to the location at which the perimeter drain can be attached to the sump pump crock 10 described herein, only shorter runs of perimeter drains could be used. As such, in order to use the same length of perimeter drains (i.e., to provide the same rise and/or run) that can be used with the sump pump crock 10 of the present disclosure, larger (e.g., deeper) traditional sump pump crocks or multiple shorter sump pump crock would have to be used. Consequently, not only is the sump pump crock 10 of the present invention easier to install that traditional sump pump crocks, but the configuration of the sump pump crock 10 of the present invention may allow for the use of a reduced number of sump pump crocks with a structure (e.g., basement of a building, or the like).

To supplement the present disclosure, this application further incorporates entirely by reference the U.S. patent application Ser. No. 17/110,838 filed on Dec. 3, 2020, and entitled "Sump Pump Crock".

It should be understood that, where possible, any of the advantages, features, functions, devices, and/or operational aspects of any of the embodiments of the present disclosure described and/or contemplated herein may be included in any of the other embodiments of the present disclosure described and/or contemplated herein, and/or vice versa.

Where possible, any terms expressed in the singular form herein are meant to also include the plural form and/or vice versa, unless explicitly stated otherwise. Accordingly, the terms "a" and/or "an" shall mean "one or more."

Moreover, it should be understood that "operatively coupled," when used herein, means that the components may be formed integrally with each other, or may be formed separately and coupled together. Furthermore, "operatively coupled" means that the components may be coupled directly to each other, or to each other with one or more components located between the components that are operatively coupled together. Furthermore, "operatively coupled" may mean that the components are detachable from each other, or that they are permanently coupled together.

Furthermore, certain terminology is used herein for convenience only and is not to be taken as a limiting, unless such terminology is specifically described herein for specific embodiments. Indeed, the components may be oriented in any direction and the terminology, therefore, should be understood as encompassing such variations unless specified otherwise. The terminology includes the words specifically mentioned herein, derivatives thereof and words of similar import. For example, words such as "top", "bottom", "upper", "lower", "vertical", "horizontal", or the like are used to describe the orientation of certain features as illustrated in the Figures. Moreover, it should be understood that when using the terminology "vertical" this could mean exactly perpendicular (e.g., 90 degrees with respect to the ground) or substantially or generally perpendicular (e.g., within +/−5, 10, 15, or the like degrees from 90 degrees with respect to the ground, or the like). Furthermore, it should be understood that when using the terminology "horizonal" this could mean exactly parallel (e.g., 90 degrees with respect to the ground) or substantially or generally parallel (e.g., within +/−5, 10, 15, or the like degrees from 0 degrees with respect to the ground, or the like).

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A sump pump crock comprising:

a body comprising:

a first portion having a first upper body and a first lower body; and a second portion having a second upper body and a second lower body;

wherein the first portion and the second portion are removably operatively coupled together;

wherein the first upper body and the second upper body form an upper body having one or more upper sidewalls forming an upper opening;

wherein the first lower body and the second lower body form a lower body having one or more lower sidewalls and a base;

wherein the upper body comprises an upper external surface and an upper internal surface;

wherein the lower body comprises a lower external surface, a lower internal surface, and one or more ports, wherein the one or more ports are configured to be operatively coupled to a drain;

wherein the one or more lower sidewalls have a plurality of perforations in at least one sidewall of the one or more lower sidewalls of the lower body; and wherein the upper external surface extends radially past at least a portion of the lower external surface and the lower internal surface; and two or more flanges that extend at least partially around the body, wherein the two or more flanges comprise:

an upper flange that extends at least partially around the upper body;

a lower flange that extends at least partially around the lower body; and wherein the upper flange extends radially past the lower flange.

2. The sump pump crock of claim 1, wherein the upper internal surface extends radially past the lower external surface.

3. The sump pump crock of claim 1, wherein the one or more ports are removable and wherein the drain is a perimeter drain.

4. The sump pump crock of claim 1, further comprising:

an internal shoulder between the upper internal surface and the lower internal surface.

5. The sump pump crock of claim 4, wherein the internal shoulder is at least partially sloped from the upper internal surface downwardly towards the lower internal surface.

6. The sump pump crock as recited in claim 1, wherein the first portion comprises a first base portion and the second portion comprises a second base portion, wherein the first base portion and the second base portion comprise the base of the lower body.

7. The sump pump crock of claim 1, wherein the first portion includes one of a first tab and a first receptacle and the second portion includes one of a second tab and a second receptacle, wherein the first tab is received in the second receptacle and the second tab is received in the first receptable to operatively couple the first portion to the second portion.

8. The sump pump crock of claim 1, wherein the first portion includes three first tabs and three first openings, and the second portion includes three second tabs and three second openings.

9. The sump pump crock of claim 1, further comprising:

a removeable lid that covers a top opening in the body.

10. The sump pump crock of claim 1, further comprising:

a top flange that defines a top opening in the body.

11. The sump pump crock as recited in claim 1, wherein the upper flange is located adjacent a bottom of the upper body near the transition from the upper body to the lower body and extends radially past the upper external surface of the upper body.

12. The sump pump crock of claim 11, wherein the one or more upper sidewalls excludes the plurality of perforations.

13. A sump pump crock comprising:

a lid;

a body comprising:

an upper body having one or more upper sidewalls forming an upper opening; and a lower body having one or more lower sidewalls and a base, wherein the upper body comprises an upper external surface and an upper internal surface;

wherein the lower body comprises a lower external surface, a lower internal surface;

wherein the upper external surface extends radially past at least a portion of the lower external surface and the lower internal surface; and wherein the lower body comprises one or more ports, and wherein the one or more ports are configured to be operatively coupled to a drain; and three or more flanges that extend at least partially around the body, wherein the three or more flanges comprise:

a top flange that defines a top opening in the upper body and defining a surface to receive the lid;

an upper flange that extends at least partially around the upper body; and a lower flange that extends at least partially around the lower body;

wherein the upper flange extends radially past the lower flange.

14. The sump pump crock of claim 13, wherein the upper body comprises an upper internal surface, wherein the lower body comprises a lower internal surface, and wherein the upper internal surface extends radially past the lower external surface.

15. The sump pump crock of claim 14, further comprising:

an internal shoulder between the upper internal surface and the lower internal surface.

16. The sump pump crock of claim 13, wherein the upper flange is located adjacent a bottom of the upper body near the transition from the upper body to the lower body and extends radially past the upper external surface of the upper body.

17. The sump pump crock of claim 13, wherein the one or more lower sidewalls have a plurality of perforations in at least one sidewall of the one or more lower sidewalls.

18. The sump pump crock of claim 13, wherein the body comprises:

a first portion having a first upper body and a first lower body; and a second portion having a second upper body and a second lower body;

wherein the first portion and the second portion are removably operatively coupled together;

wherein the first upper body and the second upper body form the upper body; and wherein the first lower body and the second lower body form the lower body.

19. A method of installing a sump pump crock, the sump pump crock having:

a body comprising:

a first portion having a first upper body and a first lower body; and a second portion having a second upper body and a second lower body;

wherein the first upper body and the second upper body form an upper body having one or more upper sidewalls forming an upper opening; and wherein the first lower body and the second lower body form a lower body having one or more lower sidewalls and a base, wherein the upper body comprises an upper external surface and an upper internal surface, wherein the lower body comprises a lower external surface, a lower internal surface, and one or more ports, wherein the one or more ports are configured to be operatively coupled to a drain, wherein the one or more lower sidewalls have a plurality of perforations in at least one sidewall of the one or more lower sidewalls of the lower body; and wherein the upper external surface extends radially past at least a portion of the lower external surface and the lower internal surface, two or more flanges that extend at least partially around the body, wherein the two or more flanges comprise:

an upper flange that extends at least partially around the upper body;

a lower flange that extends at least partially around the lower body;

wherein the upper flange extends radially past the lower flange the method comprising:

installing the sump pump crock in an aperture in the ground having an opening that at least partially converges towards a bottom of the aperture such that the lower body of the sump pump crock is located in the aperture below the upper body of the sump pump crock.

* * * * *